US012765637B2

(12) United States Patent
Decker

(10) Patent No.: US 12,765,637 B2
(45) Date of Patent: Oct. 20, 2026

(54) ANTI-FATIGUE SHOE APPARATUS

(71) Applicant: DECKER BRANCH LLC, Baton Rouge, LA (US)

(72) Inventor: Edward Jerome Decker, Baton Rouge, LA (US)

(73) Assignee: DECKER BRANCH LLC, Baton Rouge, LA (US)

( * ) Notice: Subject to any disclaimer, the term of this patent is extended or adjusted under 35 U.S.C. 154(b) by 0 days.

(21) Appl. No.: 19/300,567

(22) Filed: Aug. 14, 2025

(65) Prior Publication Data

US 2025/0366565 A1 Dec. 4, 2025

Related U.S. Application Data

(63) Continuation-in-part of application No. 18/409,094, filed on Jan. 10, 2024, now Pat. No. 12,408,728.

(60) Provisional application No. 63/449,661, filed on Mar. 3, 2023.

(51) Int. Cl.

| | |
|---|---|
| ***A43B 13/16*** | (2006.01) |
| ***A43B 7/00*** | (2006.01) |
| ***A43B 7/1405*** | (2022.01) |
| ***A43B 13/12*** | (2006.01) |
| ***A43B 13/18*** | (2006.01) |

(52) U.S. Cl.

CPC ..... *A43B 13/16* (2013.01); *A43B 7/00* (2013.01); *A43B 7/1405* (2013.01); *A43B 13/12* (2013.01); *A43B 13/181* (2013.01)

(58) Field of Classification Search

CPC ... A43B 13/181; A43B 13/186; A43B 13/188; A43B 7/148; A43B 7/1405; A43B 7/1425; A43B 7/1485; A43B 7/144

USPC ..... 36/25 R

See application file for complete search history.

(56) References Cited

U.S. PATENT DOCUMENTS

| | | | | |
|---|---|---|---|---|
| 4,930,232 A | | 6/1990 | Engle | |
| 6,038,790 A | * | 3/2000 | Pyle | A43B 7/144 36/28 |
| 6,453,578 B1 | * | 9/2002 | Yung | A43B 7/22 36/43 |

(Continued)

FOREIGN PATENT DOCUMENTS

WO 2018192262 A1 10/2018

*Primary Examiner* — Marie D Bays

(74) *Attorney, Agent, or Firm* — Lemler IP, PLLC; Thomas E. Lemler

(57) ABSTRACT

An anti-fatigue shoe apparatus provides enhanced long-term comfort and support. The apparatus features a sole assembly comprising a ground-contacting outsole, a torque-reducing midsole, and an insole. The midsole includes strategically placed toe and heel cavities extending from its top surface. When the insole is coupled to the midsole, these cavities define distinct toe and heel comfort zones, which are delimited by surfaces of both the midsole and the insole. These zones are configured to be positioned beneath high-impact areas of a wearer's foot, such as the ball and heel. In some embodiments, the zones contain comfort pods made from various cushioning materials, including polyurethane foam, gel, memory foam, or cork. A network of injection canals can extend through the outsole and midsole, terminating within the comfort zones, allowing liquid comfort material to be injected directly during manufacturing to permanently integrate the cushioning features into the sole's structure.

18 Claims, 24 Drawing Sheets

(56) References Cited

U.S. PATENT DOCUMENTS 6,516,541 B2 2/2003 Cagner
7,464,490 B2 12/2008 Lebo
8,819,961 B1 * 9/2014 Ellis ..... A43B 13/14 36/43
9,565,895 B2 2/2017 Byrne
10,772,381 B2 9/2020 Schwartz
11,844,398 B2 * 12/2023 Hurd ..... A43B 13/188
12,471,668 B2 * 11/2025 Hurd ..... A43B 13/04
2003/0208930 A1 * 11/2003 Swigart ..... A43B 7/144 36/29
2004/0181970 A1 * 9/2004 Covatch ..... A43B 17/00 36/28
2005/0160626 A1 * 7/2005 Townsend ..... A43B 13/188 36/28
2006/0021251 A1 * 2/2006 Swigart ..... A43B 13/189 36/28
2008/0086916 A1 * 4/2008 Ellis ..... F16F 7/00 36/103
2009/0094856 A1 * 4/2009 Guerra ..... A43B 7/148 36/35 B
2009/0241372 A1 * 10/2009 Ryu ..... A43B 7/144 36/43
2010/0058616 A1 * 3/2010 Ryoo ..... A43B 13/182 36/102
2010/0281712 A1 * 11/2010 Campbell ..... A43B 13/04 36/35 R
2011/0214310 A1 * 9/2011 Rosenbaum ..... A43B 7/144 36/28
2012/0047768 A1 3/2012 Brave
2014/0075779 A1 * 3/2014 Bruce ..... A43B 13/181 36/29
2014/0259746 A1 * 9/2014 Abshire ..... A43B 13/181 36/28
2018/0000196 A1 * 1/2018 Lovell ..... A43B 13/186
2019/0366668 A1 * 12/2019 Ha ..... A43B 13/42
2020/0085140 A1 * 3/2020 Hurd ..... B29D 35/142
2020/0375307 A1 * 12/2020 Hurd ..... A43B 7/1485
2021/0022440 A1 * 1/2021 Hurd ..... A43B 13/146
2023/0189922 A1 * 6/2023 Ellis ..... A42B 3/064 5/655.3
2024/0188682 A1 * 6/2024 Ophir ..... A43B 7/142

* cited by examiner

ANTI-FATIGUE SHOE APPARATUS

CROSS REFERENCE TO RELATED APPLICATIONS

The present Application is a Continuation-In-Part of U.S. Non-Provisional application Ser. No. 18/409,094, filed Jan. 10, 2024, entitled "Anti-Fatigue Shoe Apparatus", which claims priority to and the benefit of U.S. Provisional Patent Application No. 63/449,661, filed Mar. 3, 2023, which is incorporated herein by reference.

TECHNICAL FIELD

The present disclosure pertains to an anti-fatigue shoe apparatus for long term usage and to improving the comfort of a worker who is required to stand for multiple long hours per day. The present disclosure further pertains to an apparatus that combines comfort and strength to a worker's foot. The apparatus is designed without the use of hard and overly sturdy materials that create extremely limited flexibility of shoes and work boots. The present disclosure utilizes novel combinations of insole, midsole, and outsole designs that provide comfort and flexibility within shoes for workers, so that comfort and support are achieved when long term static pressure on or long hours walking in work footwear are required.

BACKGROUND AND DESCRIPTION OF THE RELATED ART

Most work footwear soles are made from hard and sturdy materials due to the need for protection and durability, such materials provide very little flexibility. Work footwear that provides increased flexibility and adequate support to workers who are required to stand for multiple hours per day and/or walk several miles per day, over long periods of time, are important for the long-term health of workers. Having access to footwear that provides workers' feet with the ability to rest in the natural position while in a standing position while also providing enough support for adequate movement is increasingly necessary.

Work footwear has been available in the market for quite some time. Existing footwear is available in a multitude of various shapes, sizes, harnesses, usage purposes, and stiffnesses, all of which have the basic utility of providing comfort and support to users' feet. There have also been many variations of footwear designed for workers with the same basic utility.

The vital nature of providing proper support and comfort to workers' feet will continue to remain significant. These basic requirements are critical for all humans to preserve health and reduce the risk of various injuries. Perhaps the greatest problem that exists with work footwear is that currently available products on the market provide little flexibility and/or are designed solely for fashion. Additionally, currently available work footwear is not specifically designed for workers that are required to stand for long periods of the day nor for workers that are required to walk multiple miles per day. It is the goal of the present disclosure to use novel combinations of insole, midsole, outsole, and comfort material designs to provide comfort, support, and flexibility within work footwear, such that comfort and support are achieved when long term static pressure within or long hours of walking in work footwear are required.

U.S. Pat. No. 10,772,381 B2 discloses a shoe insole that includes a semi-rigid shell that includes a notch located on the outward side of the wearer's foot to accommodate pronation of the foot during use for providing a wearer with extended comfort. Additionally, the semi-rigid shell includes an extended side portion located opposite of the notch side on an inner side of the wearer's foot. The semi-rigid shell is shorter in length than the length of a shoe sole and slightly shorter in width and may be combined with an insole comfort cover to provide cushion between the wearer's foot and the semi-rigid shell.

U.S. Pat. No. 6,516,541 B2 discloses a toddler's and children's shoe meeting a parent's need for fashionable decoration of the toddler, while simultaneously allowing that child freedom and comfort of pedal movement, while avoiding repetitive stress injury to the foot. This reference discloses a shoe with a flexible outersole, an insole, an upper formed from a flat Thermo Plastic Rubber blank, and a toe cap fabricated in the blank via a teacup crease special-use sewing machine. The blank or preform subsequently affixed to a last and joined by a second special purpose sewing machine, or disc feed overseaming machine, to a non-woven fabric midsole or insole which, substantially completes the upper without use of an insole board. The outersole of the shoe is unitary in construction and equipped with a unique pattern of intersecting grooves, as well as, an external bridge or instep support in lieu of an inner steel shank.

U.S. Pat. No. 4,930,232 A discloses a multilayer laminate for use as a sole of a fashion or dress shoe, wherein the shoe construction includes a combination of rigid support materials and polymeric foam materials of varying Shore hardness values permanently attached atop a conventional outer sole. The specific structural configuration of the material enhances the durability of the shoe and improves the comfort it provides for its wearer when engaged in walking, strolling, or other foot-utilizing activity.

U.S. Pat. No. 7,464,490 B2 discloses a multilayered sole having an insole, a midsole, and an outsole, where the insole extends from a toe area to a heel area that has a rigid member and a flexible member for enhancing flexibility. The midsole extends from the toe area to the heel area and has a cushioning material and a structural material for enhancing comfort.

U.S. Pat. No. 9,565,895 B2 discloses an article of footwear that has a molded outsole which contains a resilient midsole located in the cavity of the outsole, the midsole has sections of different hardness in the heel area and the forefoot area, and a footbed cover which has a stretch material layer affixed to the outsole and provides a stretch zone. The stretch zone and the footbed cover work in conjunction with the midsole to absorb shock upon heel strike or other compression of the midsole to increase comfort.

U.S. Patent Application Publication 2012/0047768 A1 discloses a silicone gel insole/midsole for numerous types of footwear that is layered and bonded between the upper of a shoe and an extra-depth outsole. The silicone insole/midsole covers the entire top surface of the relatively rigid outsole of the footwear. The insole/midsole uses silicone gel material in functional relation with an article of footwear in order to enhance fit, support, comfort, cushioning and to mimic the energy dissipation properties of human soft tissue and structure.

WIPO Patent Publication No. WO 2018/192262 A1 discloses an insole or a sole having a recess in the shape of a figure-of-eight and a soft cushioning layer covering the recess in contact with the soft cushioning located on the top surface of an insole body. The figure-of-eight-shaped recess includes a rear recess, a front recess corresponding to the position of a metatarsal bone, and a middle recess communicating with the rear recess and the front recess. The front end of the front recess inclines to the inner side of the insole body and the bottom surface of the front recess rises from the edge of the recess to the center of the recess to form a raised arc surface.

All aforementioned patents and publications are incorporated herein by reference.

While these devices may be suitable for the particular purpose employed, they would not be as suitable, or suitable at all, for the purposes of the present disclosure as disclosed hereafter.

While the prior art discloses various devices and apparatuses for providing comfort to users of footwear, the present disclosure implements the use of novel combinations of insole, midsole, outsole, and comfort material configurations and designs to provide comfort, support, and flexibility within work footwear. This is advantageous because these novel configurations and designs can accommodate the comfort and support needs of workers that are required to stand for long periods of the workday, which results in significant static pressure on insoles, midsoles, and outsoles. Additionally advantageous aspects of the present disclosure also accommodate the comfort and support needs of workers that are required to walk several miles per day, which requires additional flexibility. Thus, the present disclosure ensures that workers with these needs do not experience discomfort while also allowing for workers' feet to rest in the natural position by conforming with the natural shape of the workers' feet.

SUMMARY

It is one prospect of the present disclosure to provide a novel apparatus that combines comfort and strength to a worker's foot, the apparatus is designed for long-term usage by users who spend long hours in a standing position without the use of hard and overly sturdy materials that create extremely limited flexibility of shoes and work boots, the present disclosure utilizes a novel combination of insole, midsole, and outsole designs to provide comfort to users so that comfort and support are achieved when static pressure in the users' shoes and work boots are required.

The following presents a simplified summary of the present disclosure in a simplified form as a prelude to the more detailed description that is presented herein.

In one aspect, the disclosure related to a sole assembly for a footwear. The sole assembly includes an outsole, a midsole, and an insole. The outsole defines a top outsole surface and a bottom outsole surface opposite to the top outsole surface. The bottom outsole surface is adapted to contact ground. The midsole reduces a torque or a torsional movement between a front of the sole assembly and a rear of the sole assembly. The midsole defines a top midsole surface and a bottom midsole surface opposite to the top midsole surface. The bottom midsole surface is in contact with the top outsole surface. The top midsole surface includes a midsole toe section and a midsole heel section opposite to the midsole toe section. The midsole includes a midsole toe cavity and a midsole heel cavity. The midsole toe cavity extends from the midsole toe section of the top midsole surface into a midsole body of the midsole. The midsole heel cavity extends from the midsole heel section of the top midsole surface into the midsole body of the midsole. The insole includes a top insole surface and a bottom insole surface disposed opposite to the top insole surface. The bottom insole surface is in contact with the top midsole surface. A toe comfort zone is defined within the midsole toe cavity. The toe comfort zone is delimited by a first midsole surface of the midsole and a first insole surface of the insole. A heel comfort zone is defined within the midsole heel cavity. The heel comfort zone is delimited by a second midsole surface of the midsole and a second insole surface of the insole.

In some additional, alternative, or selectively cumulative embodiments, the outsole is formed from a material selected from a group consisting of rubber, leather, and polyurethane.

In some additional, alternative, or selectively cumulative embodiments, the midsole is formed from a material selected from a group consisting of ethyl vinyl acetate, plastic, rubber, and polyurethane.

In some additional, alternative, or selectively cumulative embodiments, the bottom midsole surface is integrally formed with the top outsole surface. This provides for a better and a reliable integrated structure of the footwear.

In some additional, alternative, or selectively cumulative embodiments, the bottom insole surface is integrally formed with the top midsole surface. Such construction provides for a better and a reliable integrated structure of the footwear.

In some additional, alternative, or selectively cumulative embodiments, the midsole toe cavity is lined with a midsole toe liner to separate the midsole from the toe comfort zone and the midsole heel cavity is lined with a midsole heel liner to separate the midsole from the heel comfort zone.

In some additional, alternative, or selectively cumulative embodiments, said midsole toe liner and said midsole heel liner are formed from a material selected from the group consisting of rubber, leather, plastic, and polyurethane.

In some additional, alternative, or selectively cumulative embodiments, the midsole toe cavity and the midsole heel cavity are reinforced with a spray on material selected from the group consisting of polyurethane, polyamide, and polyacrylonitrile, and combinations thereof, to improve surface durability and aesthetics.

In some additional, alternative, or selectively cumulative embodiments, the toe comfort zone and the heel comfort zone correspondingly include comfort pods formed from a material selected from the group consisting of rubber, polyurethane foam, polyurethane gel, memory foam, vinyl, cork, and plastic.

In some additional, alternative, or selectively cumulative embodiments, the sole assembly further includes a tubular injection canal aperture disposed in the outsole. The tubular injection canal aperture leads to an outsole central injection canal. Also, a heel comfort zone canal rises vertically from said outsole central injection canal terminating within the midsole heel cavity through a midsole heel cavity injection aperture. Further, a toe comfort zone canal rises vertically from said outsole central injection canal terminating within the midsole toe cavity through a midsole toe cavity injection aperture. The outsole central injection canal, the heel comfort zone canal, and the toe comfort zone canal is adapted to receive and retain the material of the toe comfort zone and the heel comfort zone in liquid form.

In another aspect, the disclosure relates to an anti-fatigue shoe apparatus. The anti-fatigue shoe apparatus includes a main body portion and a sole assembly. The main body portion is configured to cover a foot of a wearer. The sole assembly defines a peripheral edge coupled to the main body portion and provides a supporting base for the main body portion. The sole assembly includes an outsole, a midsole, and an insole. The outsole defines a top outsole surface and a bottom outsole surface opposite to the top outsole surface. The bottom outsole surface is adapted to contact ground.

The midsole reduces a torque or a torsional movement between a front of the sole assembly and a rear of the sole assembly. The midsole defines a top midsole surface and a bottom midsole surface opposite to the top midsole surface. The bottom midsole surface is in contact with the top outsole surface. The top midsole surface includes a midsole toe section and a midsole heel section opposite to the midsole toe section. The midsole includes a midsole toe cavity and a midsole heel cavity. The midsole toe cavity extends from the midsole toe section of the top midsole surface into a midsole body of the midsole. The midsole heel cavity extends from the midsole heel section of the top midsole surface into the midsole body of the midsole. The insole includes a top insole surface and a bottom insole surface disposed opposite to the top insole surface. The bottom insole surface is in contact with the top midsole surface. A toe comfort zone is defined within the midsole toe cavity. The toe comfort zone is delimited by a first midsole surface of the midsole and a first insole surface of the insole. A heel comfort zone is defined within the midsole heel cavity. The heel comfort zone is delimited by a second midsole surface of the midsole and a second insole surface of the insole.

In some additional, alternative, or selectively cumulative embodiments, the outsole is formed from a material selected from a group consisting of rubber, leather, and polyurethane.

In some additional, alternative, or selectively cumulative embodiments, the midsole is formed from a material selected from a group consisting of ethyl vinyl acetate, plastic, rubber, and polyurethane.

In some additional, alternative, or selectively cumulative embodiments, the bottom midsole surface is integrally formed with the top outsole surface. This provides for a better and a reliable integrated structure of the anti-fatigue shoe apparatus.

In some additional, alternative, or selectively cumulative embodiments, the bottom insole surface is integrally formed with the top midsole surface. Such construction provides for a better and a reliable integrated structure of the anti-fatigue shoe apparatus.

In some additional, alternative, or selectively cumulative embodiments, the midsole toe cavity is lined with a midsole toe liner to separate the midsole from the toe comfort zone and the midsole heel cavity is lined with a midsole heel liner to separate the midsole from the heel comfort zone.

In some additional, alternative, or selectively cumulative embodiments, said midsole toe liner and said midsole heel liner are formed from a material selected from the group consisting of rubber, leather, plastic, and polyurethane.

In some additional, alternative, or selectively cumulative embodiments, the midsole toe cavity and the midsole heel cavity are reinforced with a spray on material selected from the group consisting of polyurethane, polyamide, and polyacrylonitrile, and combinations thereof, to improve surface durability and aesthetics.

In some additional, alternative, or selectively cumulative embodiments, the toe comfort zone and the heel comfort zone correspondingly include comfort pods formed from a material selected from the group consisting of rubber, polyurethane foam, polyurethane gel, memory foam, vinyl, cork, and plastic.

In some additional, alternative, or selectively cumulative embodiments, the sole assembly further includes a tubular injection canal aperture disposed in the outsole. The tubular injection canal aperture leads to an outsole central injection canal. Also, a heel comfort zone canal rises vertically from said outsole central injection canal terminating within the midsole heel cavity through a midsole heel cavity injection aperture. Further, a toe comfort zone canal rises vertically from said outsole central injection canal terminating within the midsole toe cavity through a midsole toe cavity injection aperture. The outsole central injection canal, the heel comfort zone canal, and the toe comfort zone canal is adapted to receive and retain the material of the toe comfort zone and the heel comfort zone in liquid form.

In yet other aspects of the present disclosure, a sole assembly for a footwear is described. The sole assembly includes an outsole, a midsole, and a insole. The outsole defines a top outsole surface and a bottom outsole surface opposite to the top outsole surface. The bottom outsole surface is adapted to contact ground. The midsole defines a top midsole surface and a bottom midsole surface opposite to the top midsole surface. The bottom midsole surface is in contact with the top outsole surface. The top midsole surface includes a midsole toe section and a midsole heel section opposite to the midsole toe section. The midsole includes a midsole toe cavity and a midsole heel cavity. The midsole toe cavity extends from the midsole toe section of the top midsole surface into a midsole body of the midsole. The midsole heel cavity extends from the midsole heel section of the top midsole surface into the midsole body of the midsole. Further, the insole includes a top insole surface and a bottom insole surface disposed opposite to the top insole surface. The bottom insole surface is in contact with the top midsole surface. A toe comfort zone is defined within the midsole toe cavity. The toe comfort zone is delimited by a first midsole surface of the midsole and a first insole surface of the insole. The toe comfort zone is configured to be positioned beneath a ball of a foot of a wearer when the footwear is worn. Also, a heel comfort zone is defined within the midsole heel cavity. The heel comfort zone is delimited by a second midsole surface of the midsole and a second insole surface of the insole. The heel comfort zone is configured to be positioned beneath a heel of the foot of the wearer when the footwear is worn. Moreover, a tubular injection canal aperture is disposed in the outsole. The tubular injection canal aperture leads to an outsole central injection canal. A heel comfort zone canal rises vertically from said outsole central injection canal terminating within the midsole heel cavity through a midsole heel cavity injection aperture and a toe comfort zone canal rises vertically from said outsole central injection canal terminating within the midsole toe cavity through a midsole toe cavity injection aperture. The outsole central injection canal, the heel comfort zone canal, and the toe comfort zone canal are adapted to receive and retain the material of the toe comfort zone and the heel comfort zone in liquid form.

BRIEF DESCRIPTION OF THE DRAWINGS

Illustrative embodiments of the present disclosure are described herein with reference to the accompanying drawings, in which.

DETAILED DESCRIPTION

Figure 1:
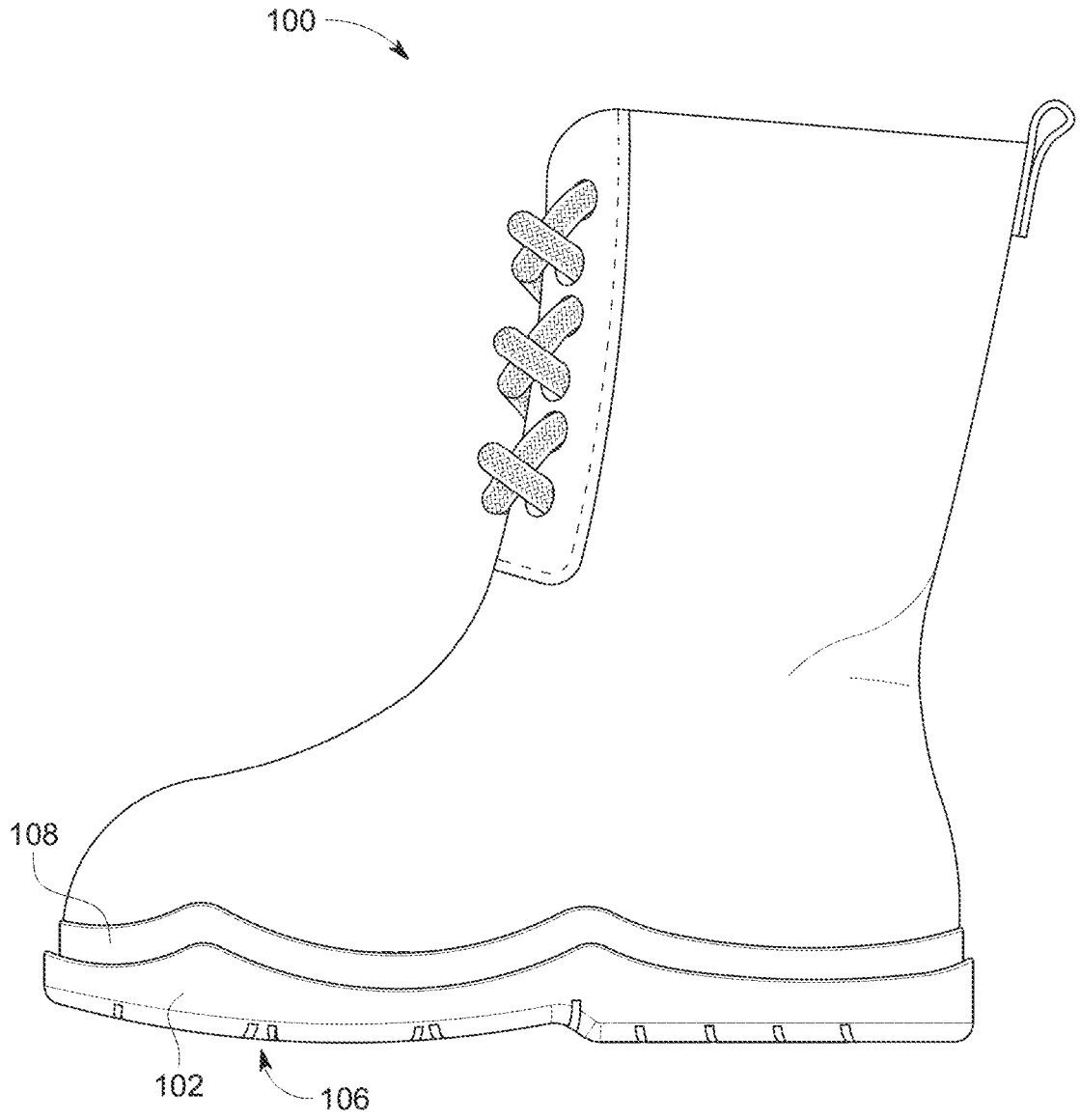
FIG. 1 is a right side elevation view of an anti-fatigue shoe apparatus within a work boot, according to a preferred embodiment of the present disclosure.

For a further understanding of the nature and function of the embodiments, reference should be made to the following detailed description. Detailed descriptions of the embodiments are provided herein, as well as, the best mode of carrying out and employing aspects of the present disclosure. It will be readily appreciated that the embodiments are well adapted to carry out and obtain the ends and features mentioned as well as those inherent herein. It is to be understood, however, that aspects of the present disclosure may be embodied in various forms. Therefore, persons of ordinary skill in the art will realize that the following disclosure is illustrative only and not in any way limiting, as the specific details disclosed herein provide a basis for the claims and a representative basis for teaching to employ aspects of the present disclosure in virtually any appropriately detailed system, structure, or manner. It should be understood that the devices, materials, methods, procedures, and techniques described herein are presently representative of various embodiments. Other embodiments of the disclosure will readily suggest themselves to such skilled persons having the benefit of this disclosure.

Referring initially to FIGS. 1-4, the basic constructional details and principles of operation of an anti-fatigue shoe apparatus 100 according to a preferred embodiment of the present disclosure will be discussed.

FIGS. 1-4 illustrate a preferred embodiment of the anti-fatigue shoe apparatus 100 that includes an outsole 102 that has a top outsole surface 104 that is opposite a bottom outsole surface 106. The bottom outsole surface 106 is adapted to grip the ground. Although the present disclosure provides for increased flexibility of work footwear, the anti-fatigue shoe apparatus 100 has a midsole 108 that is adapted to reduce torque. The midsole 108 has a top midsole surface 110 that is opposite a bottom midsole surface 112.

Figure 2:
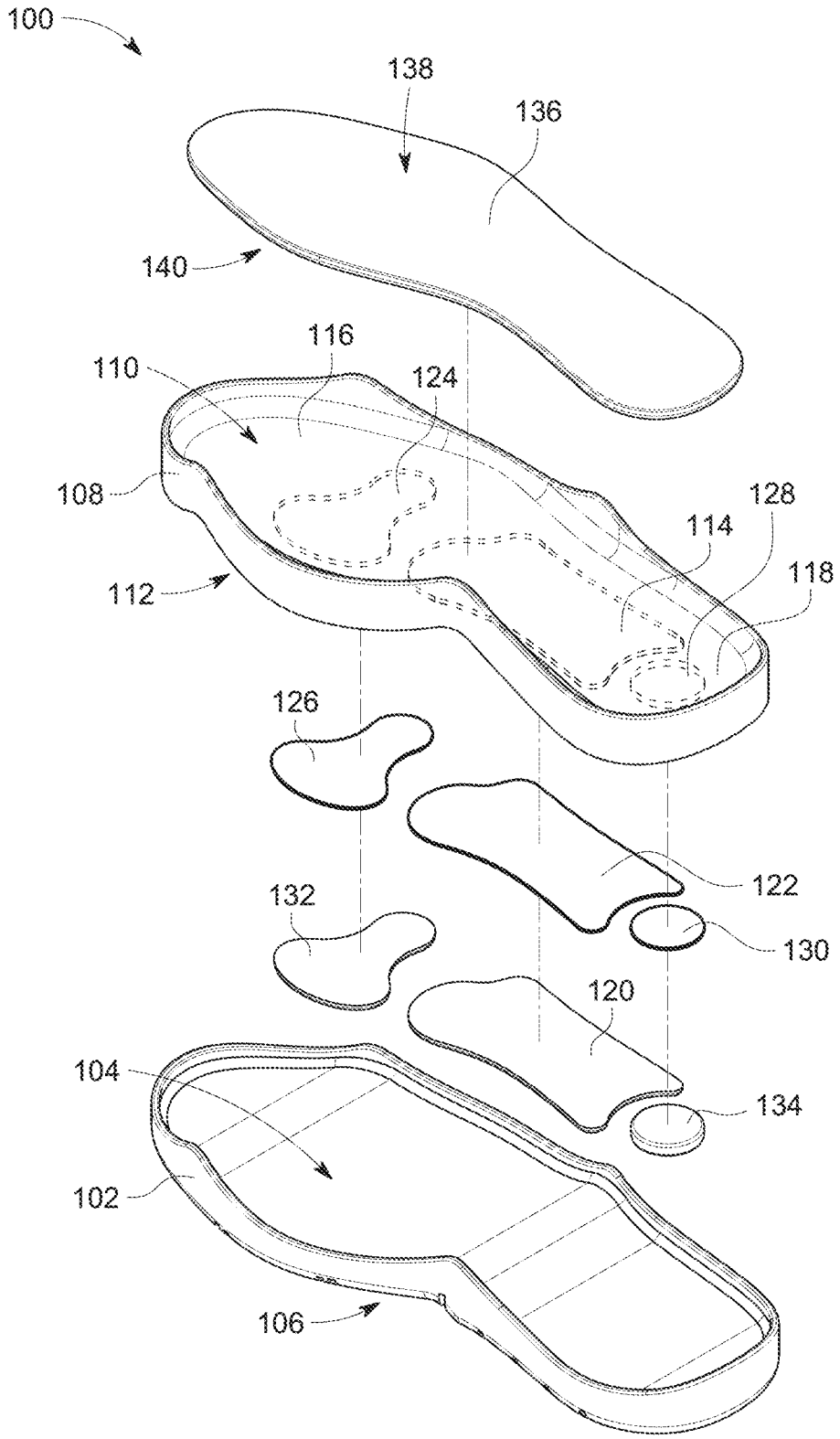
FIG. 2 is a top, rear, left side exploded perspective view of an anti-fatigue shoe apparatus, according to a preferred embodiment of the present disclosure.
Figure 3:
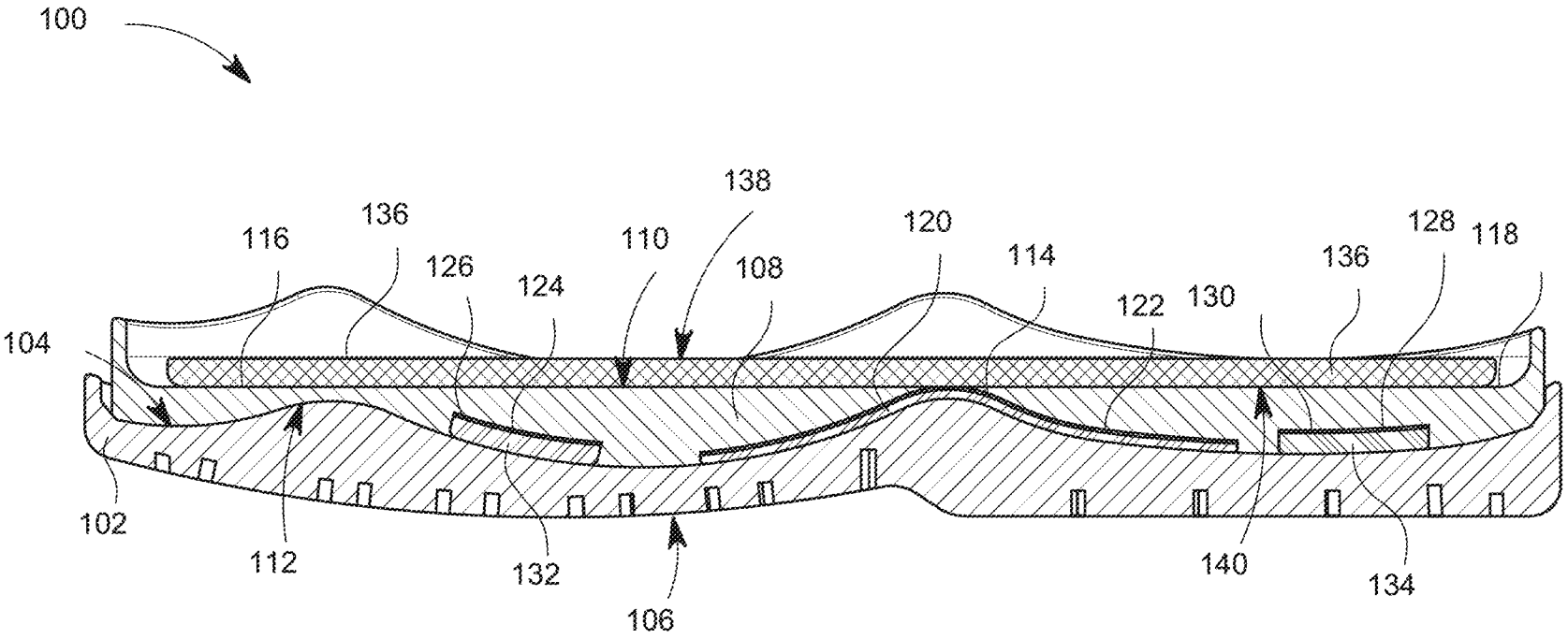
FIG. 3 is a right side cross-sectional elevation view thereof, according to preferred embodiments.

In accordance with the present disclosure, as illustrated in FIGS. 2 and 3, a midsole arch cavity 114 is centrally formed within the bottom midsole surface 112 of the midsole 108 and is located between a midsole toe section 116 that is oriented laterally opposite of a midsole heel section 118. A raised arch shaped support piece 120 is oriented within and adhered to the bottom midsole surface 112 of the midsole arch cavity 114. The raised arch shaped support piece 120 is adapted to the natural curvature of a human foot. The anti-fatigue shoe apparatus 100 includes a midsole arch liner 122 that is adhered to and located within the bottom midsole surface 112 of the midsole arch cavity 114, as shown in FIG. 2, the midsole arch liner 122 is located between the midsole bottom surface 112 and the raised arch shaped support piece 120. A midsole toe cavity 124 is formed in a substantially elliptical shape and located within the bottom midsole surface 112 of the midsole toe section 116. The midsole toe cavity 124 is lined with a midsole toe liner 126. A midsole heel cavity 128 is formed in a substantially oval shape and is located within the bottom midsole surface 112 of the midsole heel section 118. The midsole heel cavity 128 is also lined with a midsole heel liner 130.

In accordance with the present disclosure, as illustrated in FIGS. 2 and 3, a toe comfort zone 132 is located within the midsole toe cavity 124 and a heel comfort zone 134 is located within the midsole heel cavity 128. The anti-fatigue shoe apparatus 100 includes an insole 136 that has a top insole surface 138 oriented opposite a bottom insole surface 140. The bottom insole surface 140 is adhered to the top midsole surface 110 and the bottom midsole surface 112 is adhered to the top outsole surface 104.

In one embodiment, the outsole 102, shown in FIGS. 1-4, of the anti-fatigue shoe apparatus 100 is formed from a material selected from the group consisting of rubber, leather, and polyurethane.

In another embodiment, the midsole 108, shown in FIGS. 1-4, of the anti-fatigue shoe apparatus 100 is formed from a material selected from the group consisting of ethyl vinyl acetate, plastic, rubber, and polyurethane.

Figure 4:
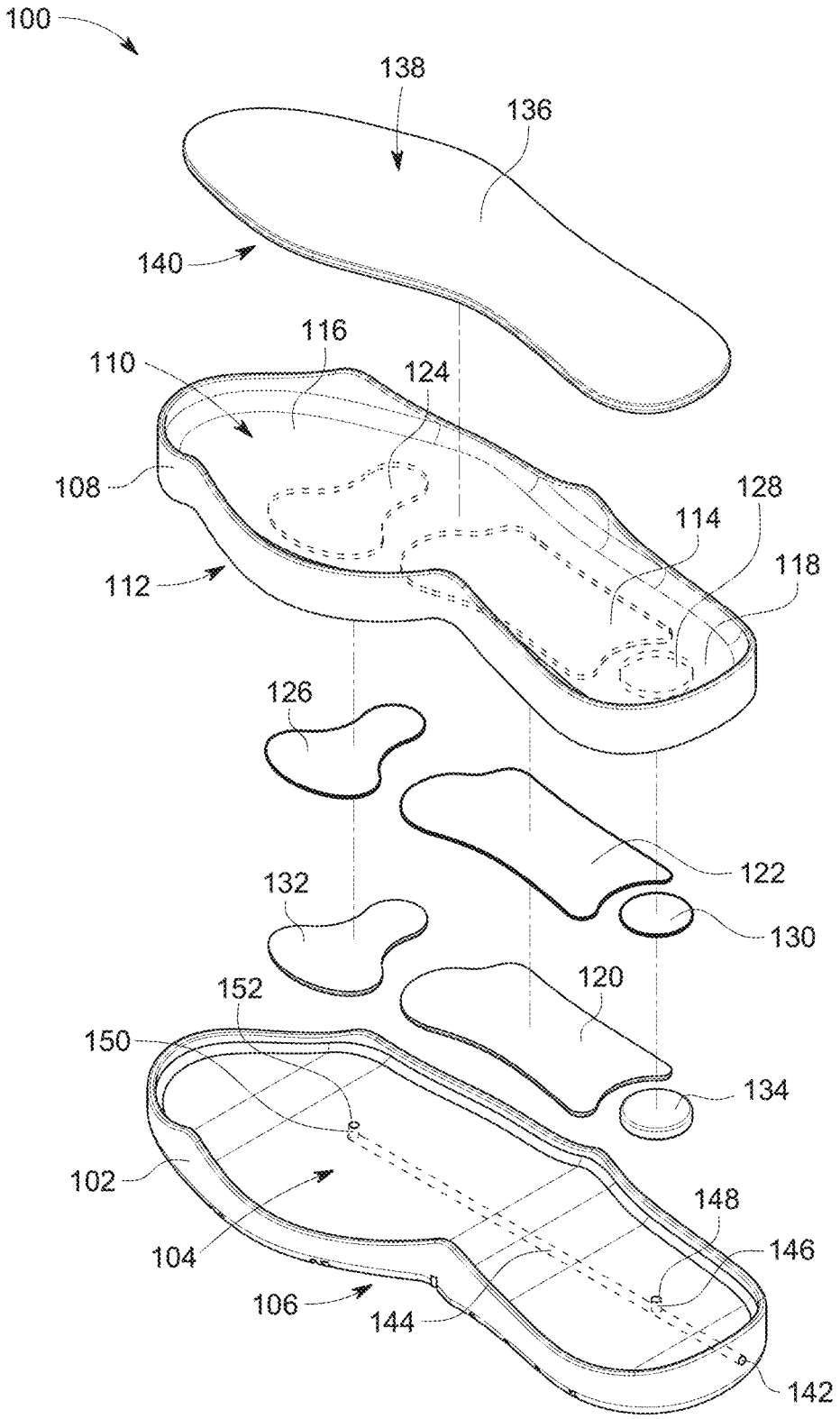
FIG. 4 is a top, rear, left side exploded perspective view of an anti-fatigue shoe apparatus, according to a preferred embodiment of the present disclosure.

In yet another embodiment, as illustrated in FIGS. 2-4, the raised arch shaped support piece 120 of the anti-fatigue shoe apparatus 100 is formed from a material selected from the group consisting of ethyl vinyl acetate, plastic, rubber, polyurethane foam, polyurethane gel, memory foam, vinyl, cork, and plastic.

In one embodiment, as shown in FIGS. 2-4, the midsole arch liner 122 of the anti-fatigue shoe apparatus 100 is formed from a material selected from the group consisting of rubber, leather, plastic, and polyurethane.

In another embodiment, as shown in FIGS. 2-4, the midsole toe liner 126 and the midsole heel liner 130 of the anti-fatigue shoe apparatus 100 are formed from a material selected from the group consisting of rubber, leather, plastic, and polyurethane.

In yet another embodiment, the midsole toe cavity 124 and the midsole heel cavity 128 are reinforced with a spray on material selected from the group consisting of polyurethane, polyamide, and polyacrylonitrile, and combinations thereof.

In one embodiment, illustrated in FIGS. 2-4, the toe comfort zone 132 and the heel comfort zone 134 of the anti-fatigue shoe apparatus 100 are formed from a material selected from the group consisting of rubber, polyurethane form, polyurethane gel, memory foam, vinyl, cork, and plastic.

Turning to FIG. 4, in another embodiment, the anti-fatigue shoe apparatus 100 further includes a tubular injection canal aperture 142 that is located in the outsole 102. The tubular injection canal aperture 142 leads to an outsole central injection canal 144. In accordance with the present embodiment, a heel comfort zone canal 146 rises vertically from the outsole central injection canal 144 and terminates within the midsole heel cavity 128 through a midsole heel cavity injection aperture 148. A toe comfort zone canal 150 also rises vertically from the outsole central injection canal 144 and terminates within the midsole toe cavity 124 through a midsole toe cavity injection aperture 152. In accordance with this embodiment of the anti-fatigue shoe apparatus 100, the outsole central injection canal 144, the heel comfort zone canal 146, and the toe comfort zone canal 150 are adapted to receive and retain the material that the toe comfort zone 132 and the heel comfort zone 134 are made out of in liquid form.

As illustrated in FIGS. 5-10, preferred embodiments of an anti-fatigue shoe apparatus 200 are provided for.

Figure 5:
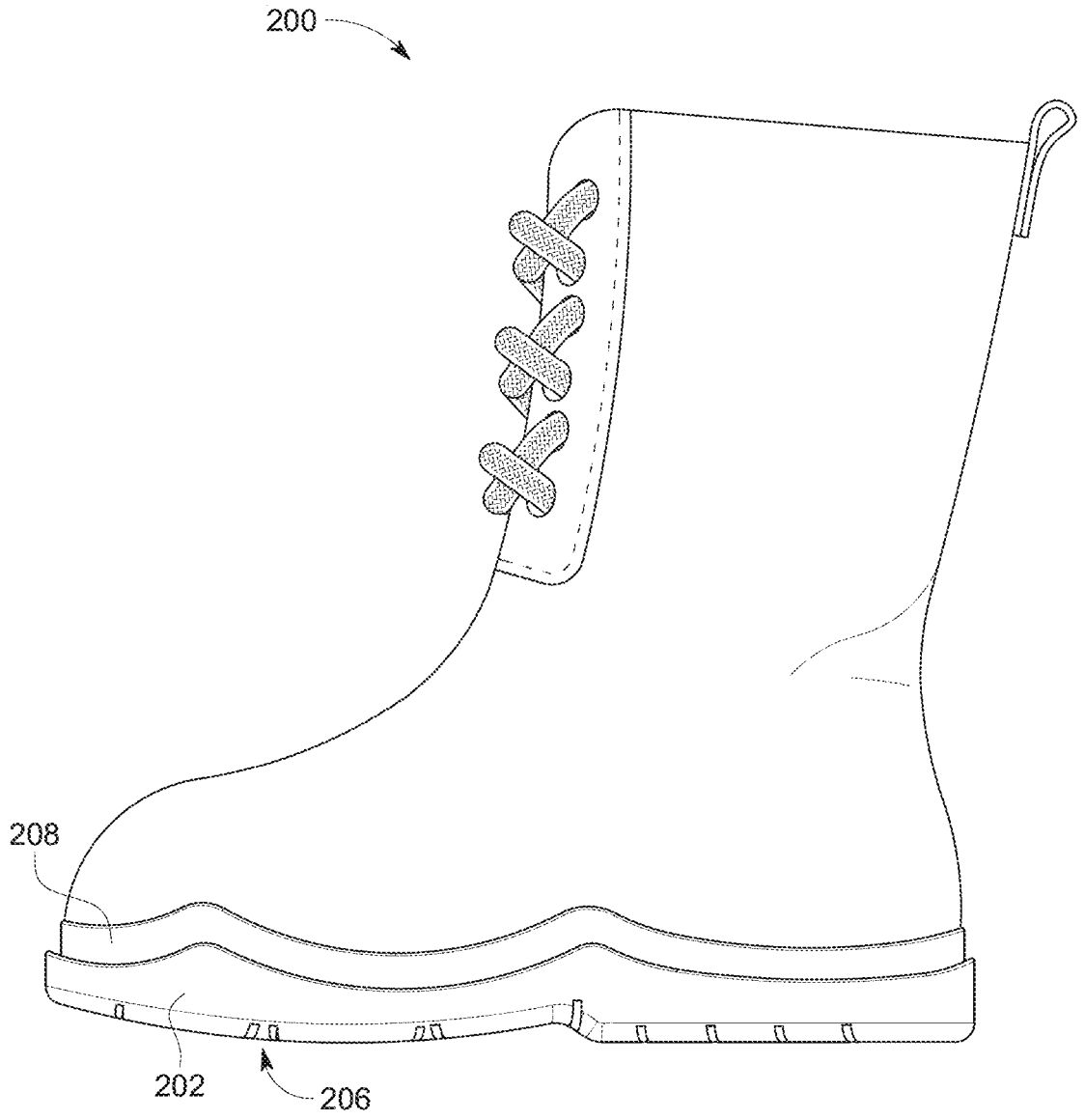
FIG. 5 is a right side elevation view of an anti-fatigue shoe apparatus within a work boot, according to a preferred embodiment of the present disclosure.
Figure 6:
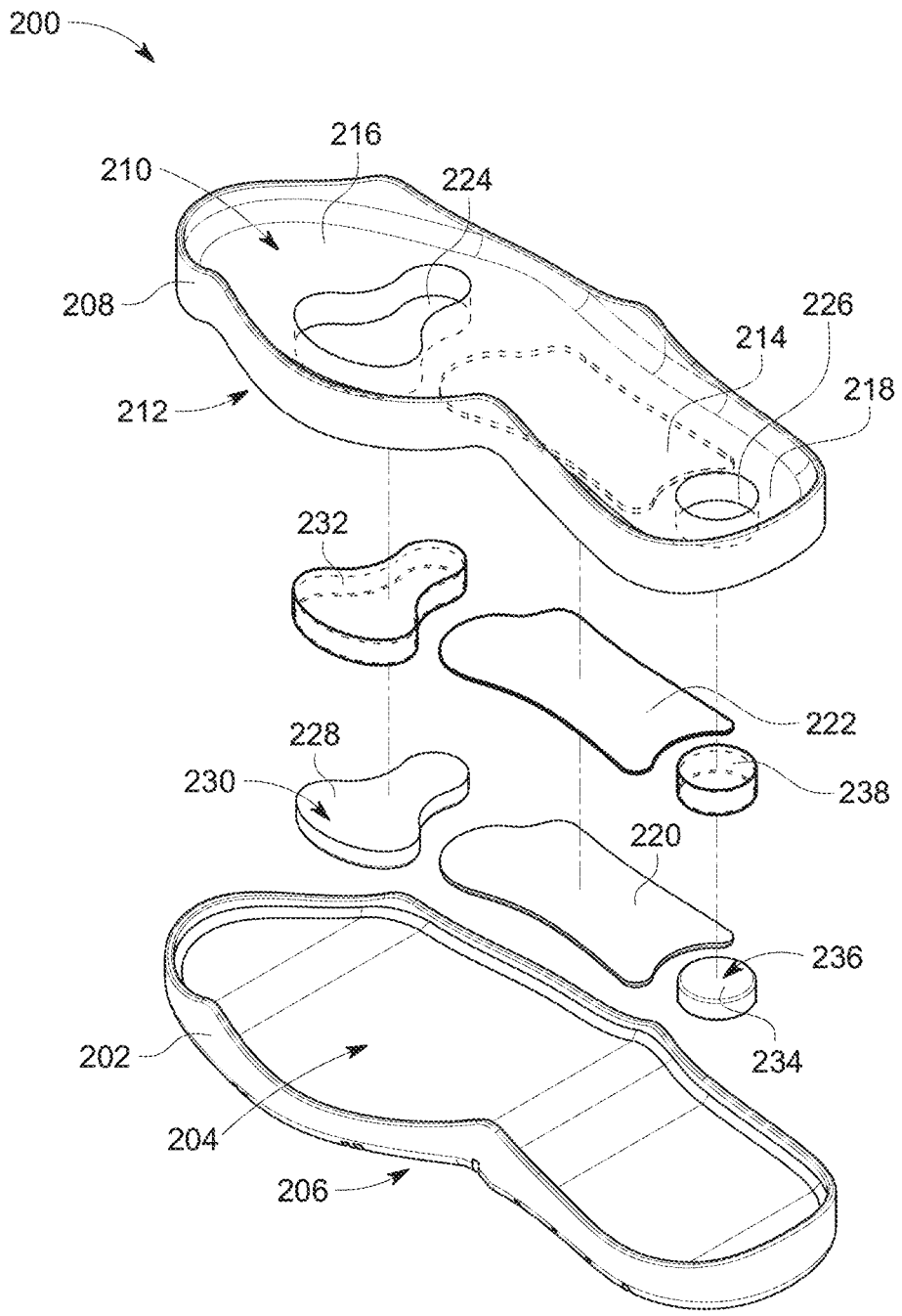
FIG. 6 is a top, rear, left side exploded perspective view of an anti-fatigue shoe apparatus, according to a preferred embodiment of the present disclosure.
Figure 7:
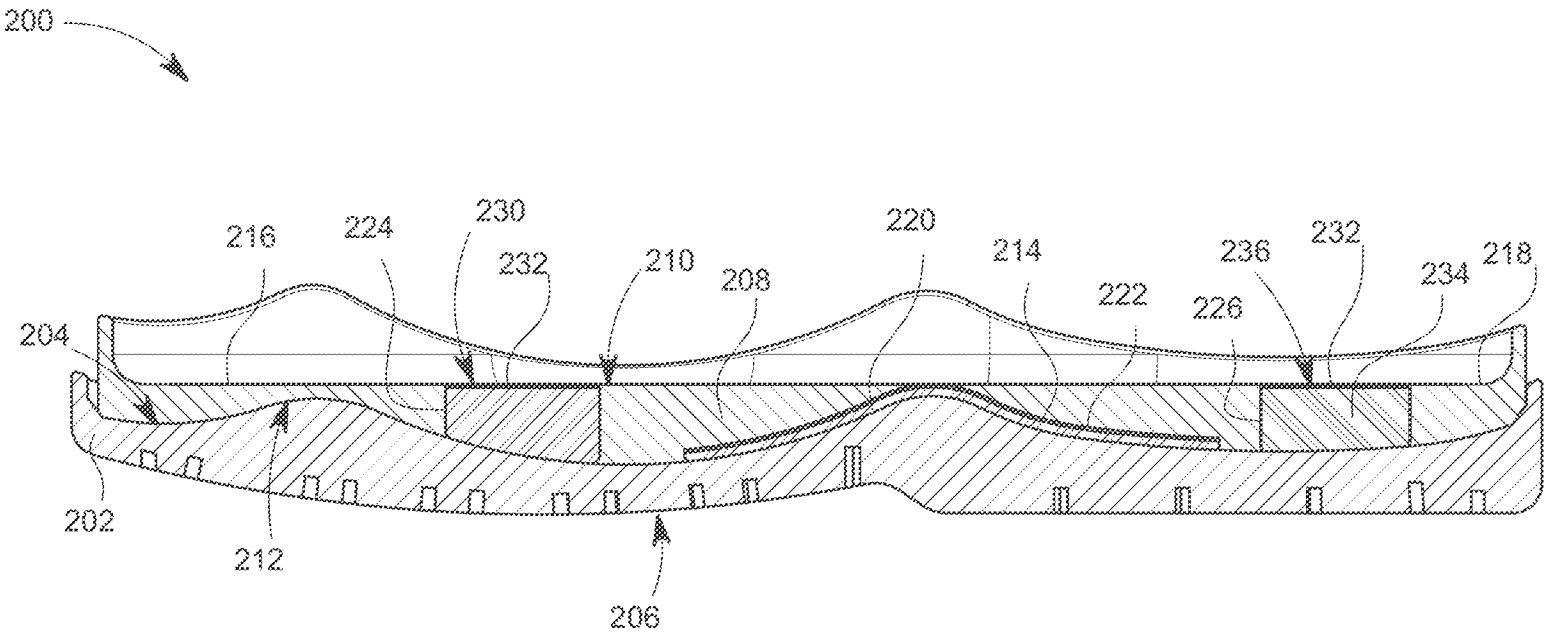
FIG. 7 is a right side cross-sectional elevation view thereof, according to preferred embodiments.

In such preferred embodiment of the disclosure, referring to FIGS. 5-7, the anti-fatigue shoe apparatus 200 includes an outsole 202 that has a top outsole surface 204 that is oriented opposite a bottom outsole surface 206. The bottom outsole surface 206 is designed to grip the ground. The anti-fatigue shoe apparatus 200 further includes a midsole 208 that is designed to reduce torque. As illustrated in FIGS. 6-7, the midsole 208 has a top midsole surface 210 that is oriented opposite a bottom midsole surface 212.

In accordance with the present disclosure, a midsole arch cavity 214 is formed centrally within the bottom midsole surface 212 of the midsole 208 and is located between a midsole toe section 216 that is oriented laterally opposite a midsole heel section 218, as shown in FIG. 6. A raised arch shaped support piece 220 is located within and adhered to the bottom midsole surface 212 of the midsole arch cavity 214. The raised arch shaped support piece 220 is designed to fit the natural curvature of a human foot.

The anti-fatigue shoe apparatus 200, as shown in FIGS. 6-9, includes a midsole arch liner 222 adhered to and located within the bottom midsole surface 212 of the midsole arch cavity 214. A midsole toe aperture 224 is formed in a substantially elliptical shape and oriented though the midsole toe section 216 and a midsole heel aperture 226 is formed in a substantially oval shape and oriented through the midsole heel section 218.

In accordance with the present disclosure, as shown in FIGS. 6-9, a toe comfort zone 228 is located within the midsole toe aperture 224 and surrounded by the top midsole surface 210. Furthermore, a top surface 236 of the toe comfort zone 228 is lined with a toe comfort zone fabric 232 that is designed for direct contact with a ball of the human foot. A heel comfort zone 234 is located within the midsole heel aperture 226 and is also surrounded by the top midsole surface 210. A top surface 236 of the heel comfort zone 234 is lined with a heel comfort zone fabric 238 that is designed for direct contact with a heel of the human foot and the bottom midsole surface 212 is adhered to the top outsole surface 204.

Figure 8:
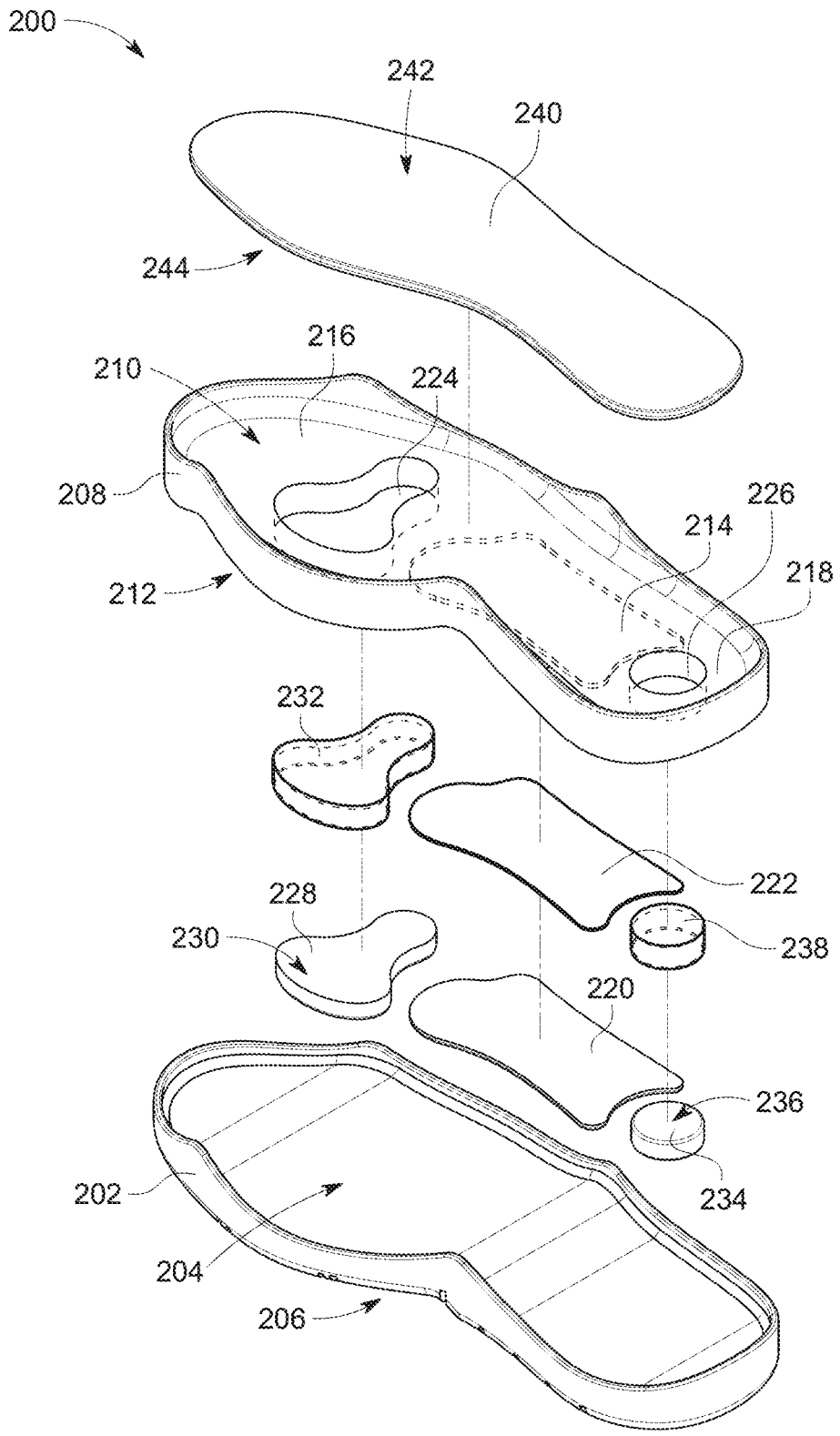
FIG. 8 is a top, rear, left side exploded perspective view thereof, with the insole option included, according to a preferred embodiment of the present disclosure.
Figure 9:
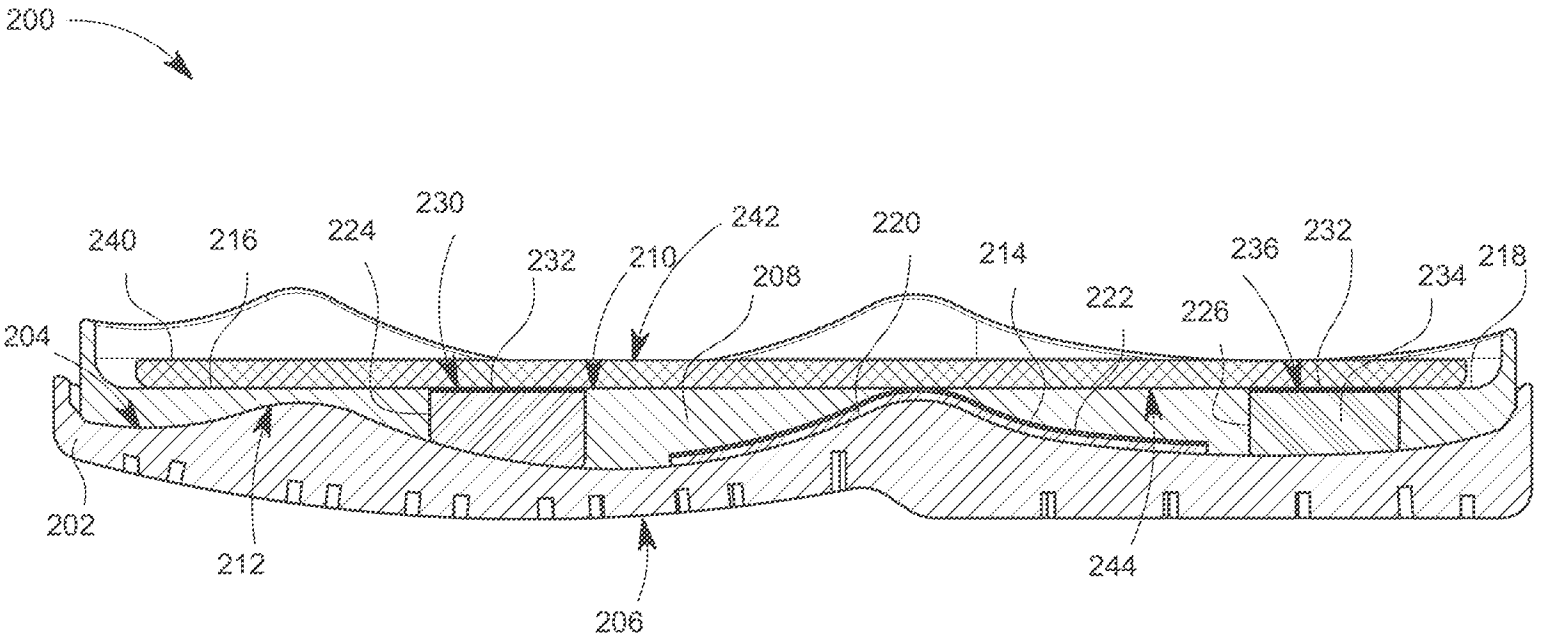
FIG. 9 is a right side cross-sectional elevation view thereof, according to preferred embodiments.

In one embodiment, turning to FIGS. 8 and 9, the anti-fatigue shoe apparatus 200 further includes an insole 240 having a top insole surface 242 oriented opposite a bottom insole surface 244. In such embodiment, the bottom insole surface 244 is adhered to the top midsole surface 210.

In another embodiment, the outsole 202, as shown in FIGS. 5-10, is formed from a material selected from the group consisting of rubber, leather, and polyurethane.

In yet another embodiment, as shown in FIGS. 5-10, the midsole 208 is formed from a material selected from the group consisting of ethyl vinyl acetate, plastic, rubber, and polyurethane.

In one embodiment, as illustrated in FIGS. 6-10, the raised arch shaped support piece 220 is formed from a material selected from the group consisting of ethyl vinyl acetate, plastic, rubber, polyurethane foam, polyurethane gel, memory foam, vinyl, cork, and plastic.

In another embodiment, shown in FIGS. 6-10, the midsole arch liner 222 is formed from as material selected from the group consisting of rubber, leather, plastic, and polyurethane.

In yet another embodiment, illustrated in FIGS. 6-10, the toe comfort zone fabric 232 and the heel comfort zone fabric 238 are formed from a material selected from the group consisting of petroleum, polyurethane, and leather, and combinations thereof.

In one embodiment, shown in FIGS. 6-10, the toe comfort zone 228 and the heel comfort zone 234 are formed from a material selected from the group consisting of rubber, polyurethane form, polyurethane gel, memory foam, vinyl, cork, and plastic.

Figure 10:
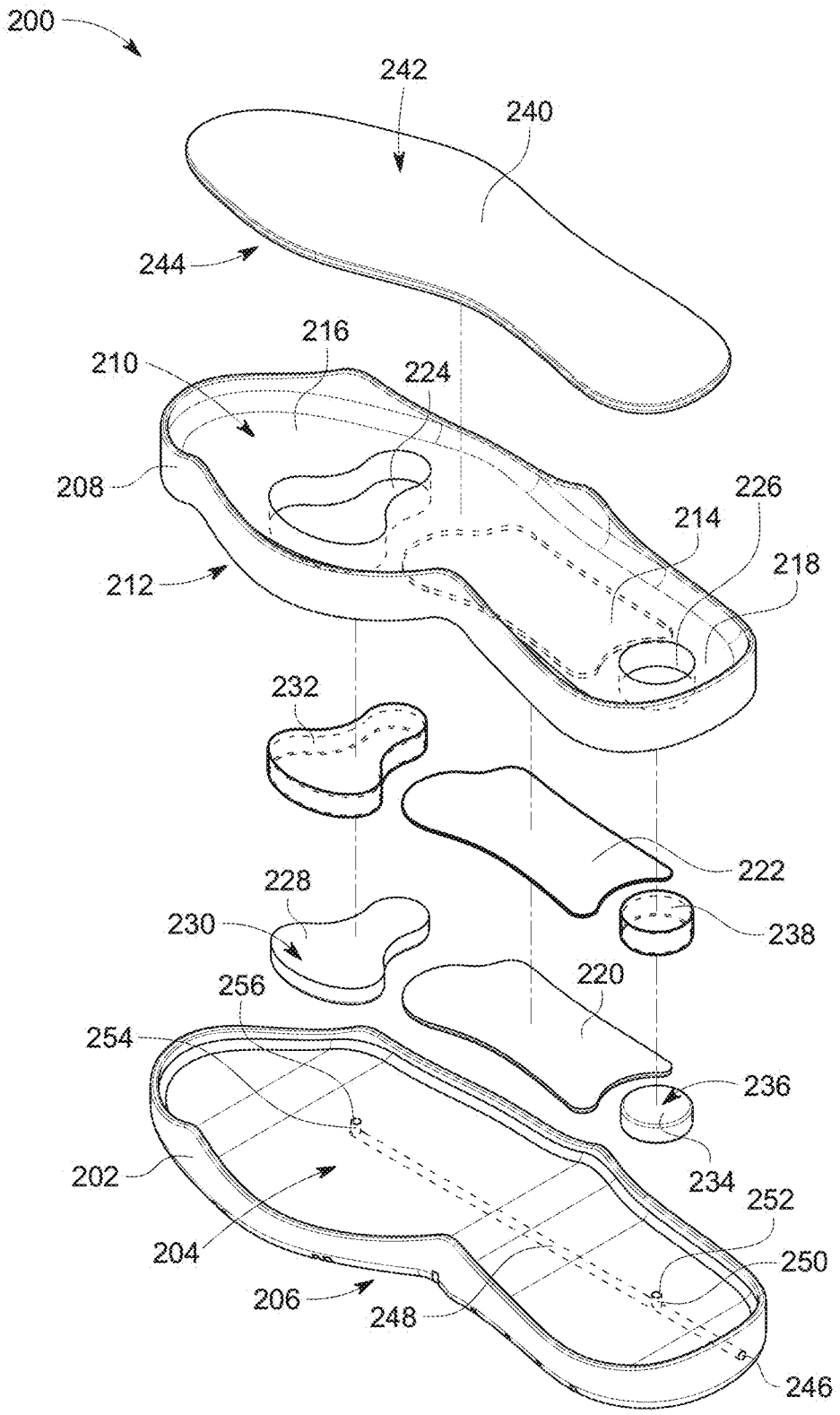
FIG. 10 is a top, rear, left side exploded perspective view thereof, with the insole option included and the injection canals for comfort zone materials, according to a preferred embodiment of the present disclosure.

Turning to FIG. 10, in another related embodiment, the anti-fatigue shoe apparatus 200 further includes a tubular injection canal aperture 246 located in the outsole 202. The tubular injection canal aperture 246 leads to an outsole central injection canal 248, where a heel comfort zone canal 250 rises vertically from the outsole central injection canal 248 and terminates within the midsole heel aperture 226 through a midsole heel injection aperture 252. In accordance with such embodiment of the disclosure, a toe comfort zone canal 254 rises vertically from the outsole central injection canal 248 and terminates within the midsole toe aperture 224 through a midsole toe injection aperture 256. The outsole central injection canal 248, the heel comfort zone canal 250, and the toe comfort zone canal 254 are designed to receive and retain the material of the toe comfort zone 228 and the heel comfort zone 234 in liquid form.

As illustrated in FIGS. 11-16, additional preferred embodiments of an anti-fatigue shoe apparatus 300 are provided for.

Figure 11:
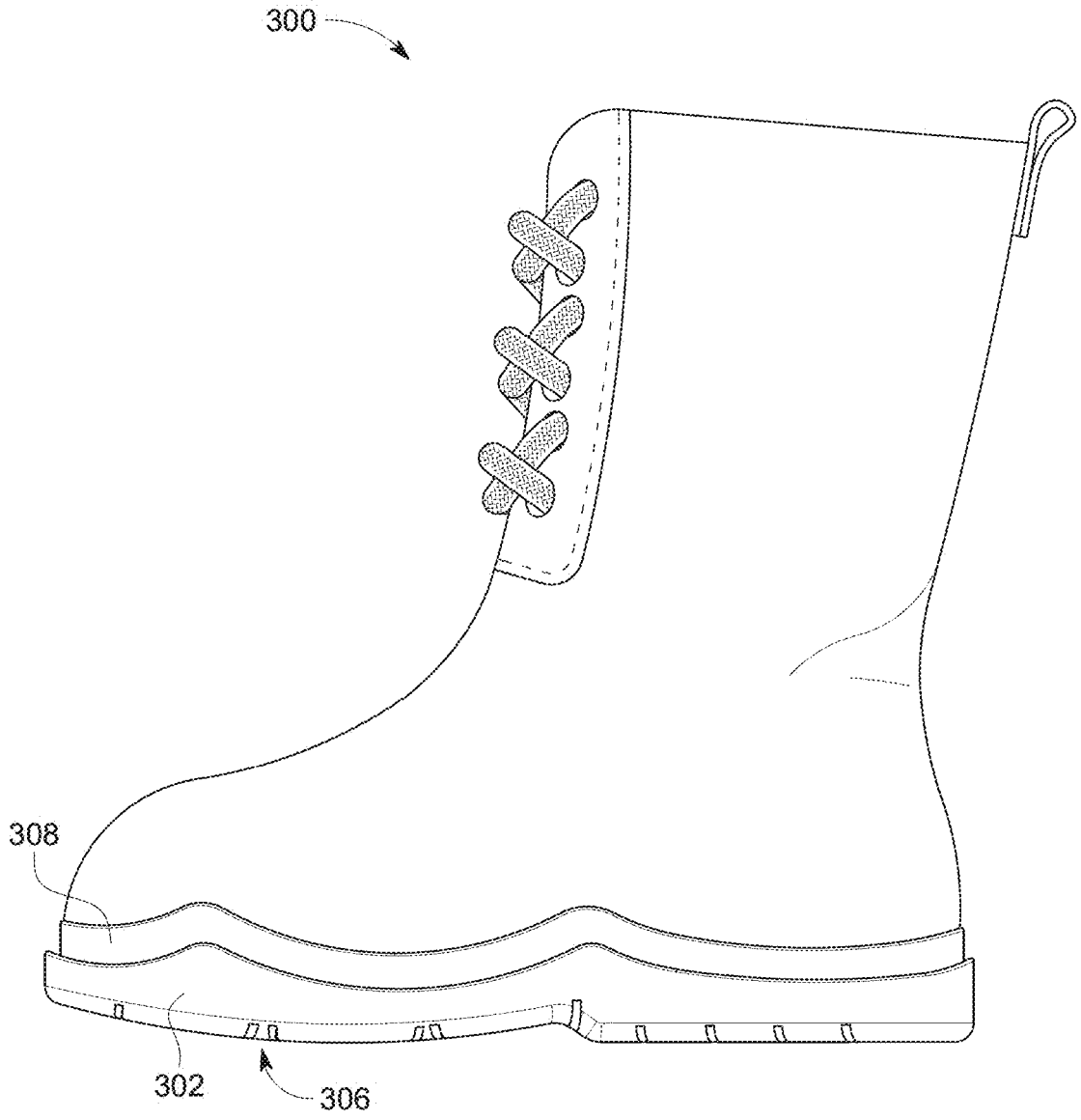
FIG. 11 is a right side elevation view of an anti-fatigue shoe apparatus within a work boot, according to a preferred embodiment of the present disclosure.
Figure 12:
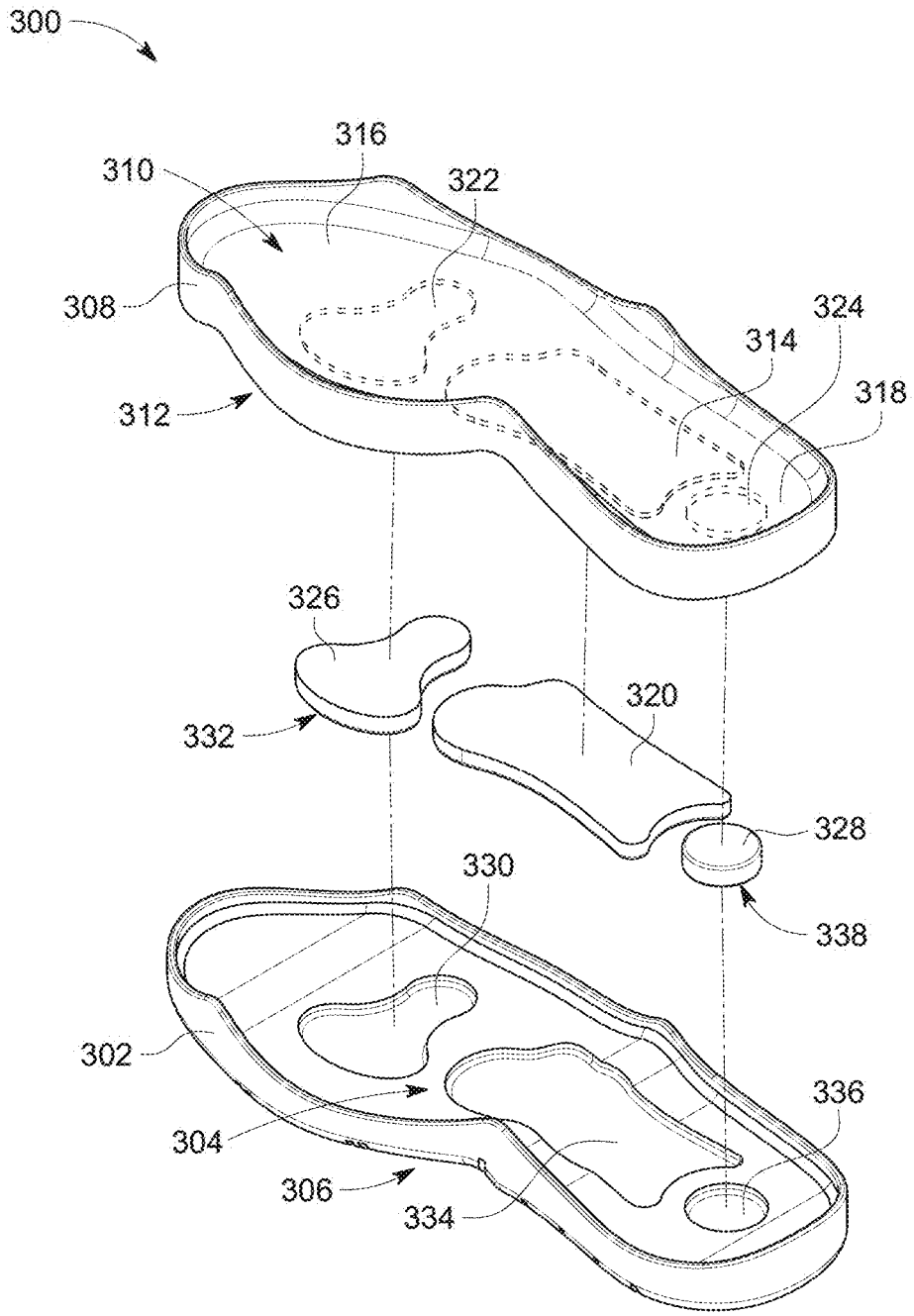
FIG. 12 is a top, rear, left side exploded perspective view of an anti-fatigue shoe apparatus, according to a preferred embodiment of the present disclosure.
Figure 13:
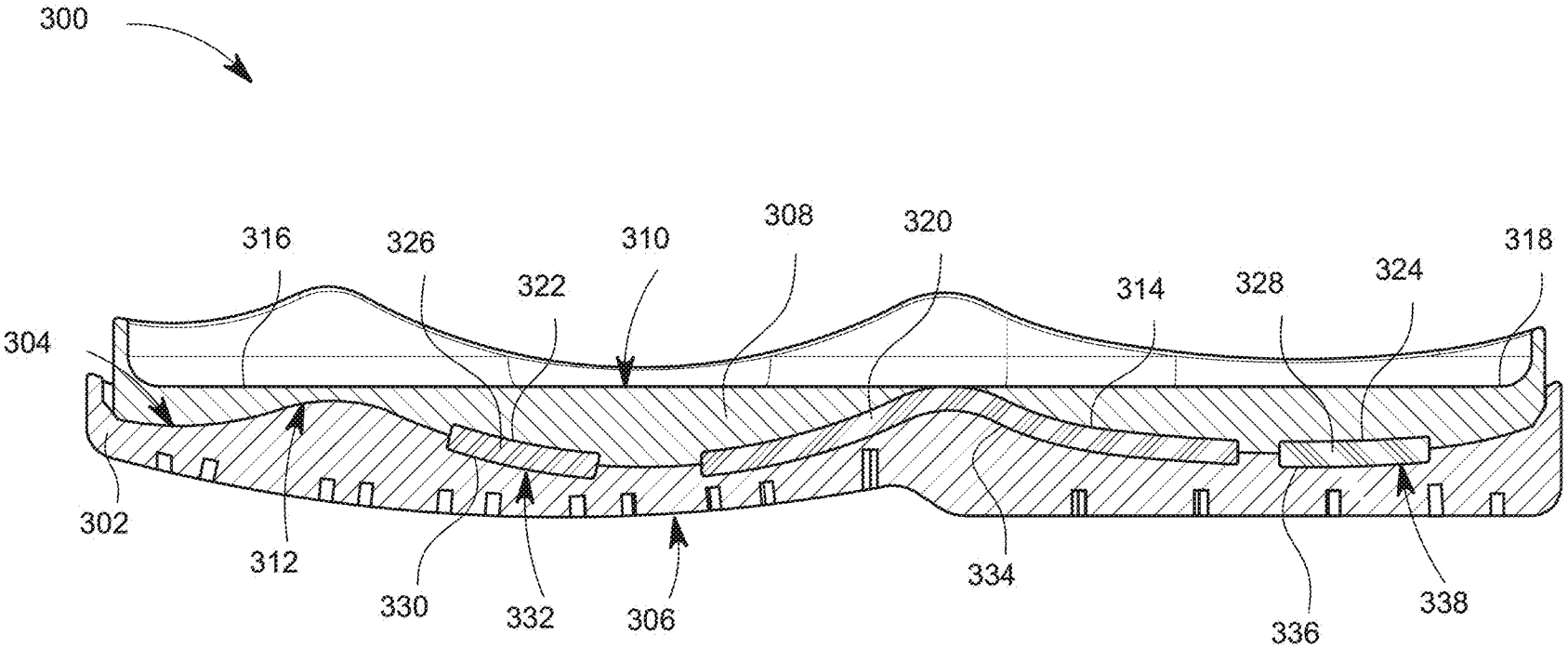
FIG. 13 is a right side cross-sectional elevation view thereof, according to preferred embodiments.

In such additional preferred embodiment of the disclosure, referring to FIGS. 11-13, the anti-fatigue shoe apparatus 300 includes an outsole 302 that has a top outsole surface 304 oriented opposite a bottom outsole surface 306. The bottom outsole surface 306 is designed to grip the ground and a midsole 308 is designed to reduce torque. As shown in FIGS. 12-15, the midsole 308 has a top midsole surface 310 oriented opposite a bottom midsole surface 312. A midsole arch cavity 314 is formed centrally within the bottom midsole surface 312 of the midsole 308 and located between a midsole toe section 316 that is oriented laterally opposite a midsole heel section 318.

In accordance with the present disclosure, shown in FIGS. 12-16, the anti-fatigue shoe apparatus 300 includes a raised arch shaped support piece 320 located within and adhered to the bottom midsole surface 312 of the midsole arch cavity 314, and the raised arch shaped support piece 320 is designed to receive the shape of the natural curvature of the arch of a human foot. Furthermore, a midsole toe cavity 322 is formed in a substantially elliptical shape and located within the bottom midsole surface 312 of the midsole toe section 316. A midsole heel cavity 324 is formed in a substantially oval shape and located within the bottom midsole surface 312 of the midsole heel section 318. The anti-fatigue shoe apparatus 300 includes an extruding toe comfort zone 326 that is adhered to and located within the midsole toe cavity 322 and an extruding heel comfort zone 328 that is adhered to and located within the midsole heel cavity 324.

Continuing to refer to FIGS. 12-16, in accordance with the present disclosure, the anti-fatigue shoe apparatus 300 also includes an outsole toe cavity 330 that is formed in a substantially elliptical shape and is located within the top outsole surface 304. The outsole toe cavity 330 is designed to receive a bottom surface 338 of the extruding toe comfort zone 326 and is aligned with the midsole toe section 316. An outsole arch cavity 334 is formed centrally within the top outsole surface 304 of the outsole 302, and the outsole arch cavity 334 is designed to receive and retain the raised arch shaped support 320.

In accordance with the present disclosure, shown in FIGS. 12-16, the anti-fatigue shoe apparatus 300 also includes an outsole heel cavity 336 that is formed in a substantially oval shape and oriented within the top outsole surface 304. The outsole heel cavity 336 is designed to receive a bottom surface 338 of the extruding heel comfort zone 328 and is aligned with the midsole heel section 318. The bottom midsole surface 312 is adhered to the top outsole surface 304.

Figure 14:
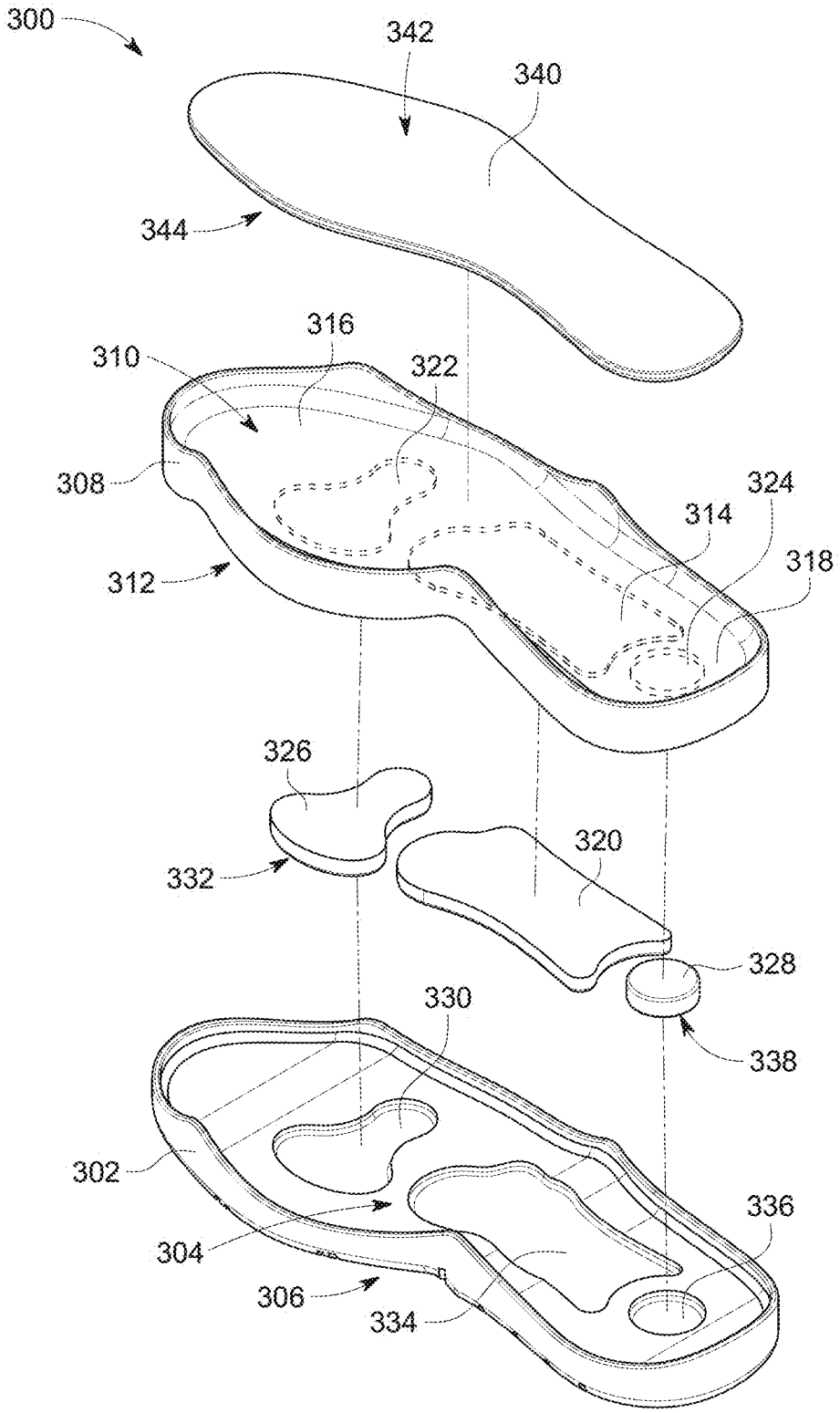
FIG. 14 is a top, rear, left side exploded perspective view thereof, with the insole option included and the injection canals for comfort zone materials, according to a preferred embodiment of the present disclosure.
Figure 15:
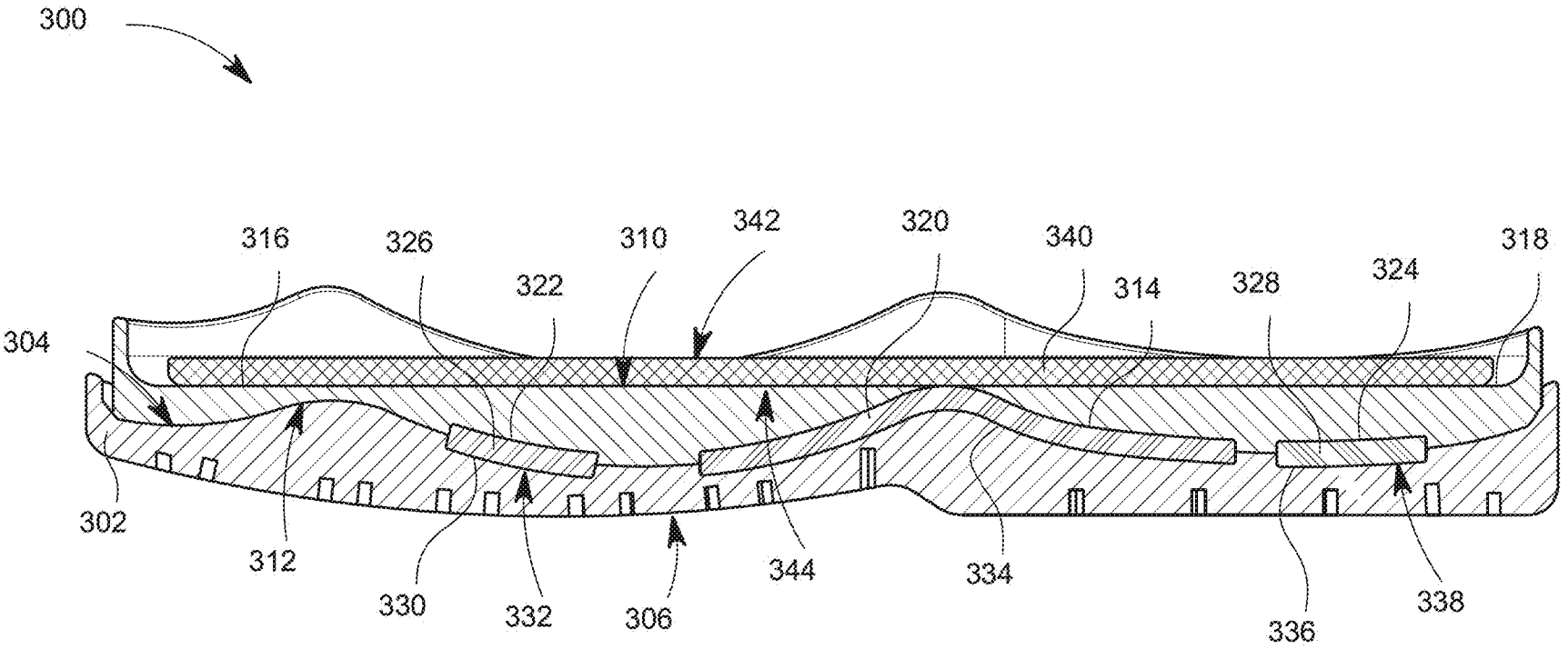
FIG. 15 is a right side cross-sectional elevation view thereof, according to preferred embodiments.
Figure 16:
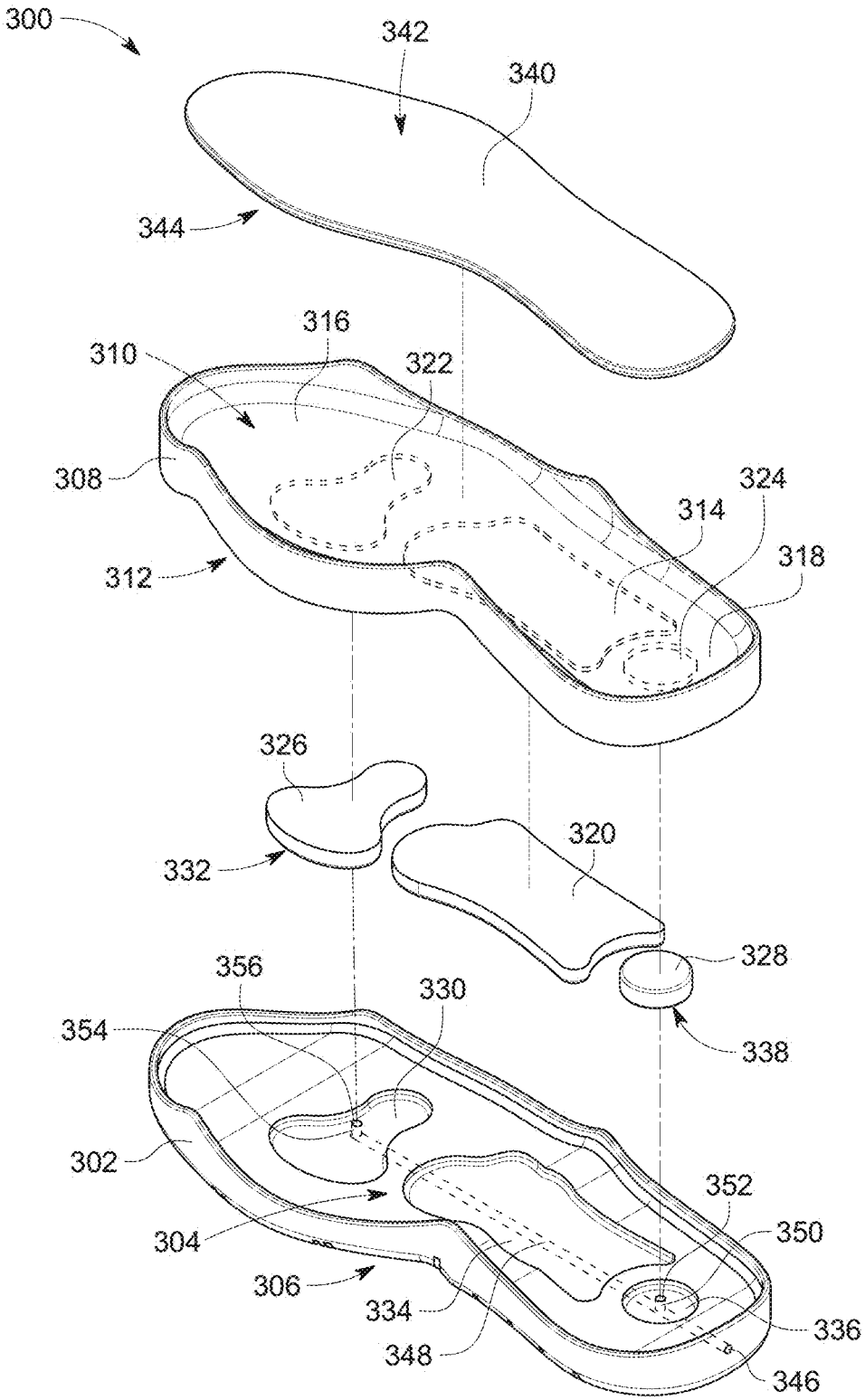
FIG. 16 is a top, rear, left side exploded perspective view thereof, with the insole option included and the injection canals for comfort zone materials, according to a preferred embodiment of the present disclosure.

In one embodiment, reflected in FIGS. 14-16, the anti-fatigue shoe apparatus 300 further includes an insole 340 that has a top insole surface 342 oriented opposite a bottom insole surface 344 and the bottom insole surface 344 is adhered to the top midsole surface 310.

In another embodiment, shown in FIGS. 11-16, the outsole 302 is formed from a material selected from the group consisting of rubber, leather, and polyurethane.

In yet another embodiment, as reflected in FIGS. 11-16, the midsole 308 is formed from a material selected from the group consisting of ethyl vinyl acetate, plastic, rubber, and polyurethane.

In one embodiment, illustrated in FIGS. 12-16, the raised arch shaped support piece 320 is formed from a material selected from the group consisting of ethyl vinyl acetate, plastic, rubber, polyurethane foam, polyurethane gel, memory foam, vinyl, cork, and plastic.

In another embodiment, as reflected in FIGS. 12-16, the midsole toe cavity 322, the midsole heel cavity 324, the outsole toe cavity 330, and the outsole heel cavity 336 are reinforced with a spray on material selected from the group consisting of polyurethane, polyamide, and polyacrylonitrile, and combinations thereof.

In yet another embodiment, the extruding toe comfort zone 326 and the extruding heel comfort zone 328, such as those in FIGS. 12-16, are formed from a material selected from the group consisting of rubber, polyurethane form, polyurethane gel, memory foam, vinyl, cork, and plastic.

Turning to FIG. 16, in another related embodiment, the anti-fatigue shoe apparatus 300 further includes a tubular injection canal aperture 346 located in the outsole 302. The tubular injection canal aperture 346 opens to a central injection canal 348. An outsole heel injection canal 350 rises vertically from the central injection canal 348 and terminates within the outsole heel cavity 336 through a heel cavity injection aperture 352.

In accordance with such embodiment of the disclosure, as illustrated in FIG. 16, an outsole toe injection canal 354 rises vertically from the central injection canal 348 and terminates within the outsole toe cavity 330 through an outsole toe cavity injection aperture 356. The central injection canal 348 is designed to be substantially U-shaped and located below the outsole arch cavity 334. The outsole heel injection canal 350, the central injection canal 348, and the outsole toe injection canal 354 is designed to receive and retain the material of the extruding toe comfort zone 326 and the extruding heel comfort zone 328 in liquid form.

As illustrated in FIGS. 17-20, another additional preferred embodiment of an anti-fatigue shoe apparatus 400 is provided.

Figure 17:
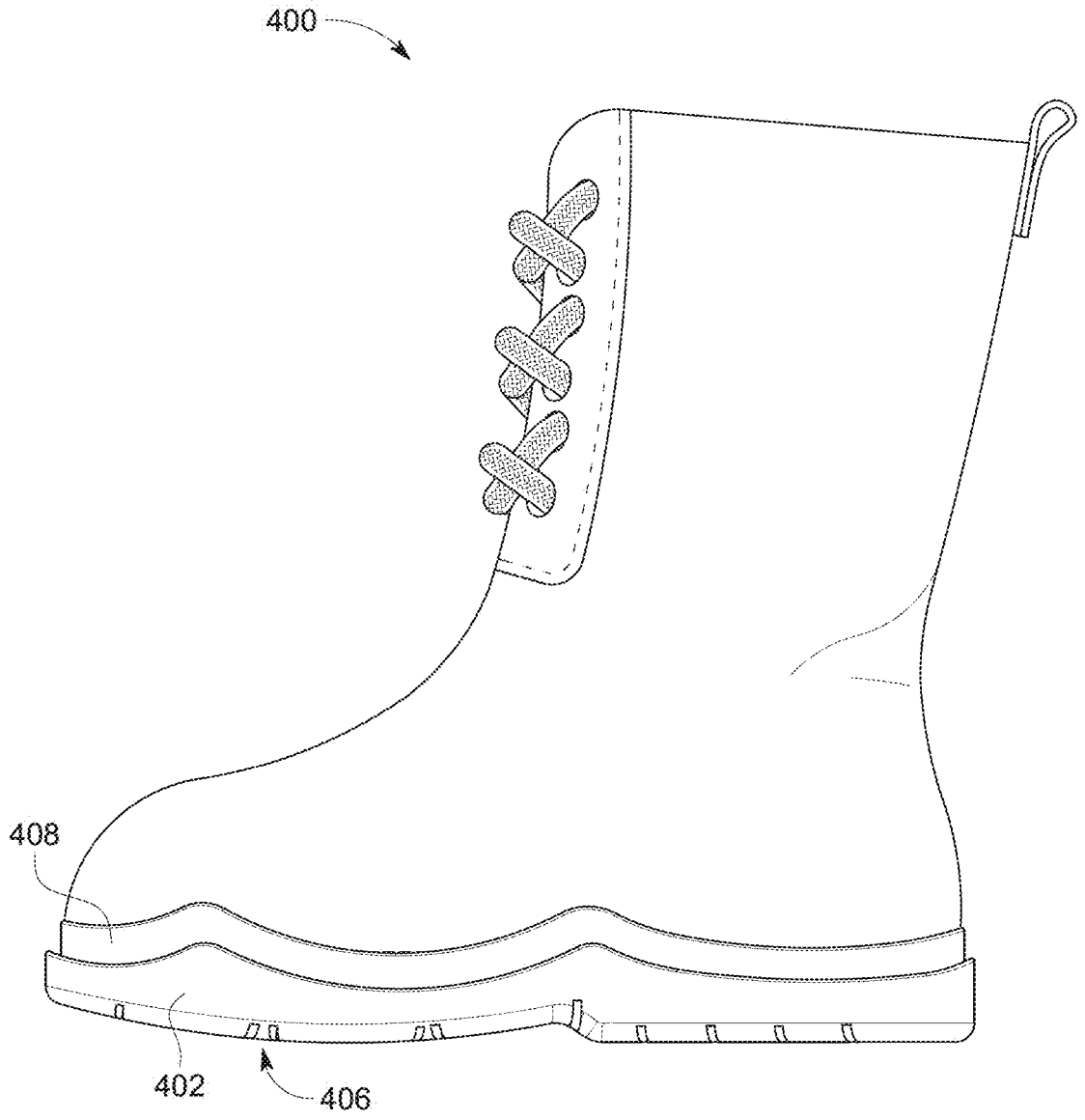
FIG. 17 is a right side elevation view of an anti-fatigue shoe apparatus within a work boot, according to a preferred embodiment of the present disclosure.
Figure 18:
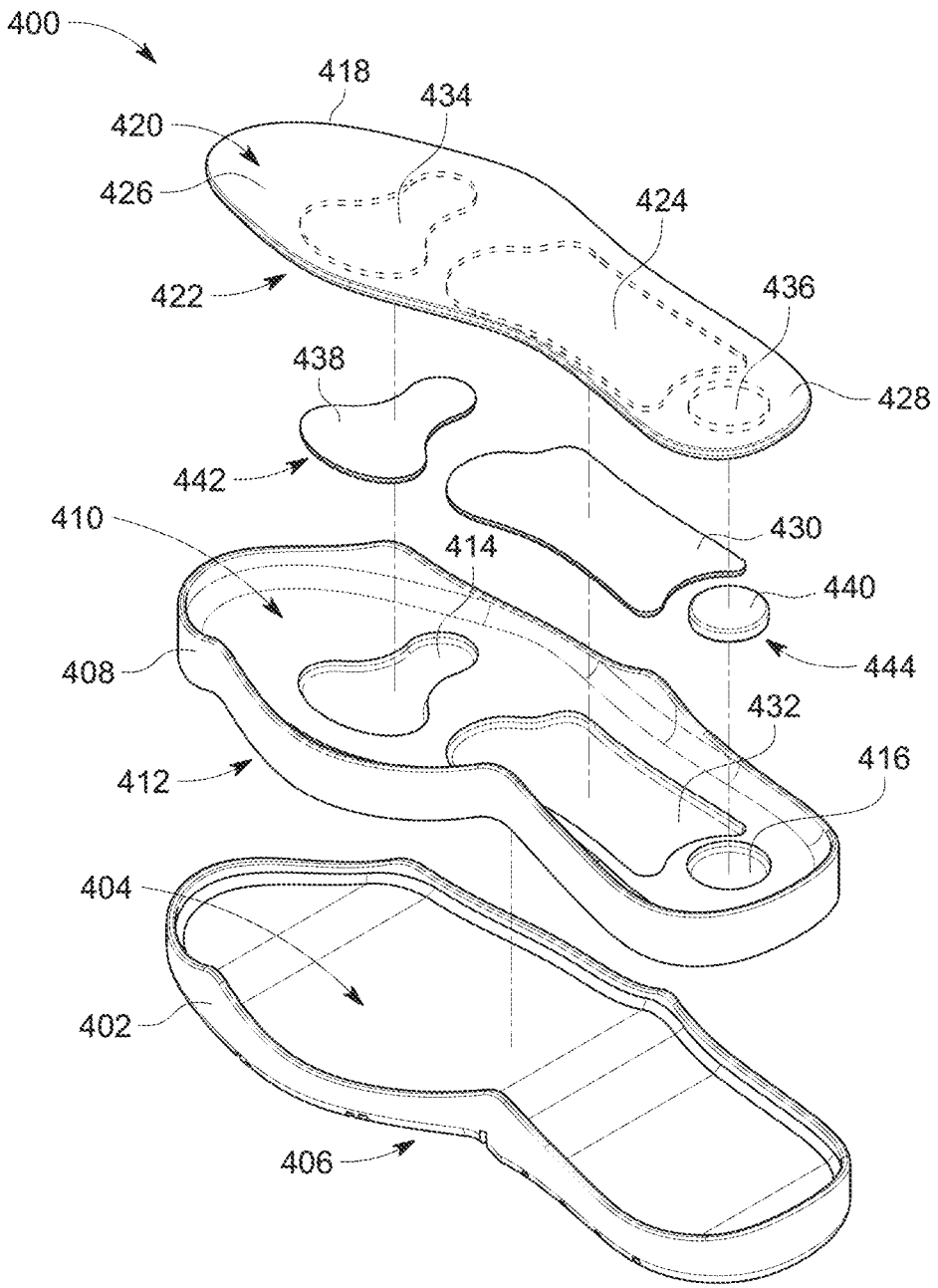
FIG. 18 is a top, rear, left side exploded perspective view of an anti-fatigue shoe apparatus, according to a preferred embodiment of the present disclosure.
Figure 19:
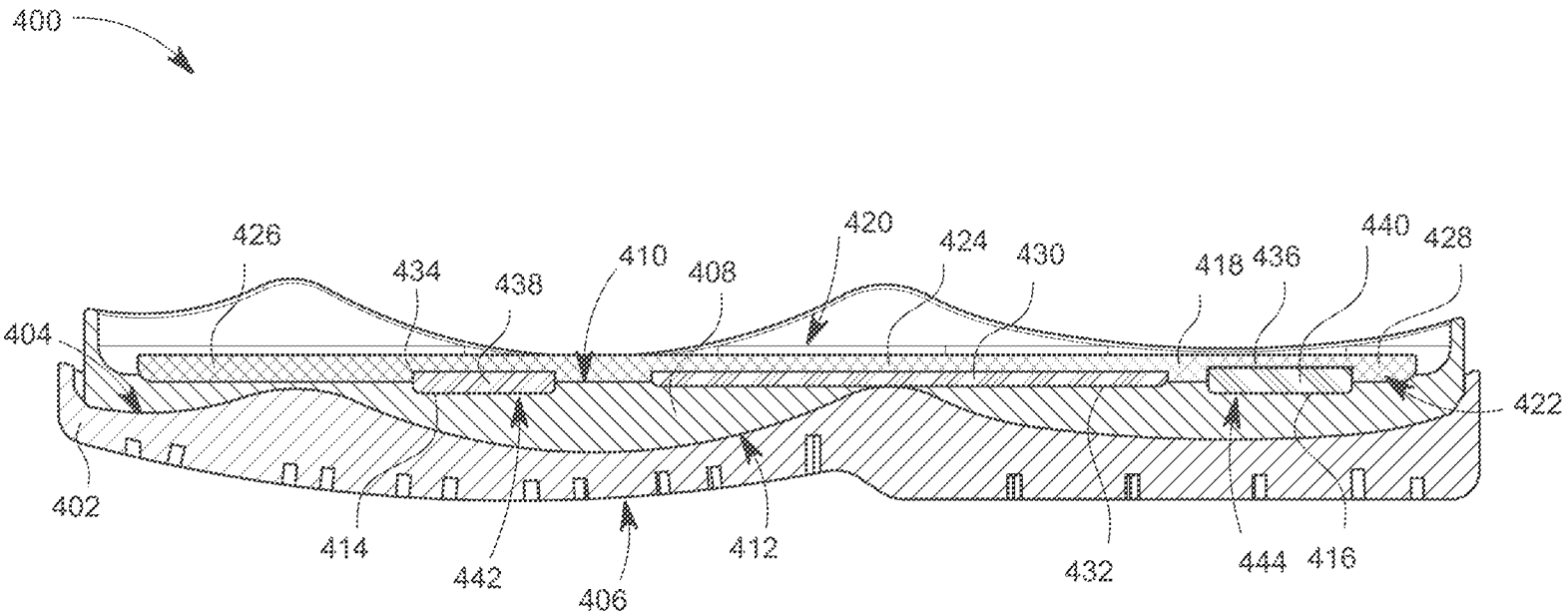
FIG. 19 is a right side cross-sectional elevation view thereof, according to preferred embodiments.
Figure 20:
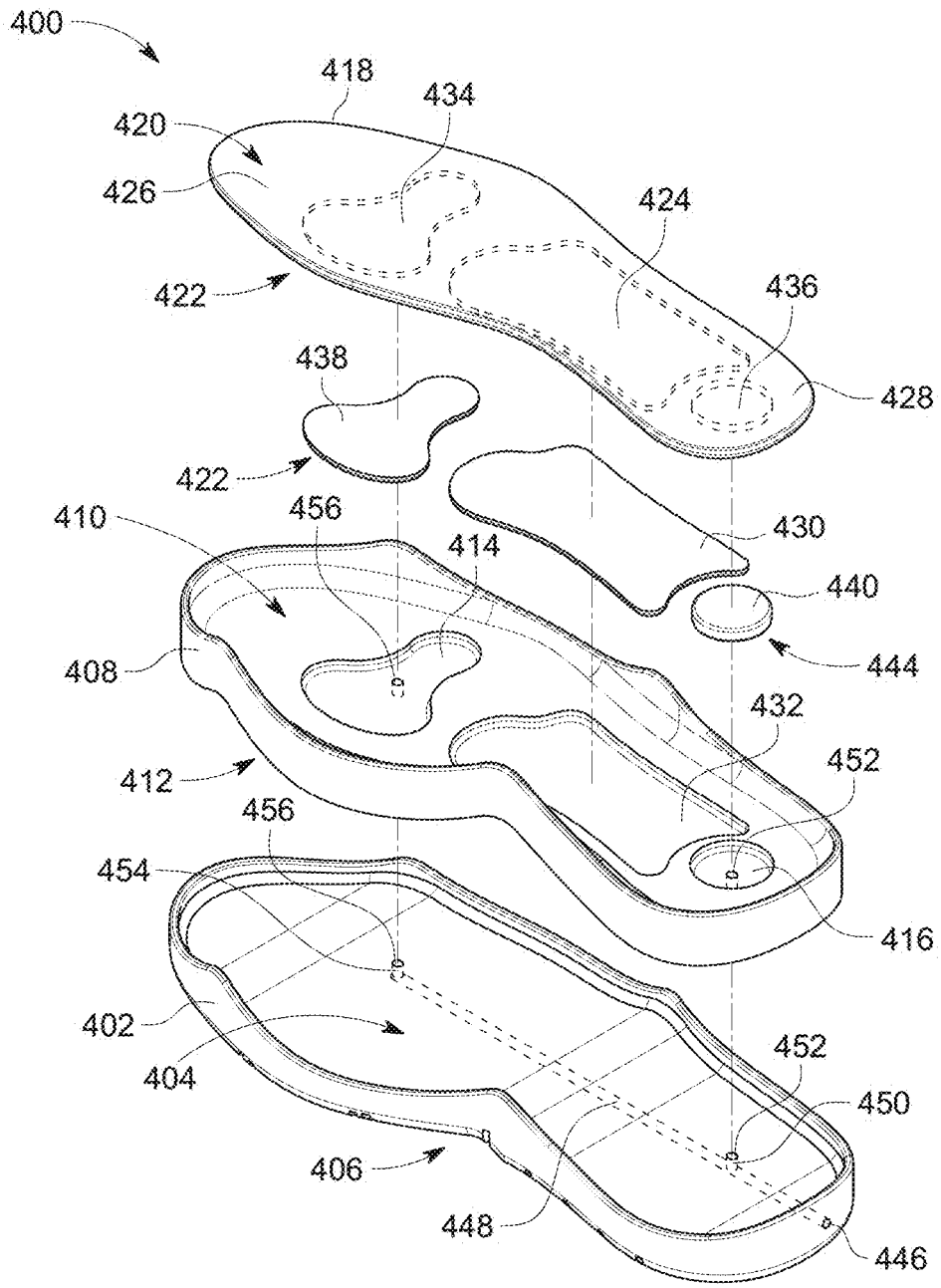
FIG. 20 is a top, rear, left side exploded perspective view thereof, with the injection canals for comfort zone materials, according to a preferred embodiment of the present disclosure

In such additional and/or preferred embodiment of the aspects of the present disclosure, referring to FIGS. 17-19, the anti-fatigue shoe apparatus 400 includes an outsole 402 that has a top outsole surface 404 oriented opposite a bottom outsole surface 406. The bottom outsole surface 406 is designed to grip the ground. The anti-fatigue shoe apparatus 400 also includes a midsole 408 that has a top midsole surface 410 oriented opposite a bottom midsole surface 412. As illustrated in FIGS. 18-20, the top midsole surface 410 includes a midsole toe cavity 414 that is oriented laterally opposite from a midsole heel cavity 416. The midsole toe cavity 414 is formed in a substantially elliptical shape and located within the top midsole surface 410, where the midsole heel cavity 416 is formed in a substantially oval shape and is located within the top midsole surface 410.

Continuing to refer to FIGS. 18-20, in accordance with the present disclosure, the anti-fatigue shoe apparatus 400 includes an insole 418 that has a top insole surface 420 oriented opposite a bottom insole surface 422. An insole arch cavity 424 is formed centrally within the bottom insole surface 422 and the insole arch cavity 424 is located between an insole toe section 426 of the bottom insole surface 422 which is oriented laterally opposite from an insole heel section 428 of the bottom insole surface 422.

The anti-fatigue shoe apparatus 400, referring to FIGS. 18-20, includes a raised arch shaped support piece 430 located within and adhered to the bottom insole surface 422 of the insole arch cavity 424. A midsole arch cavity 432 is centrally formed within the top midsole surface 410 and the midsole arch cavity 432 is located between the midsole toe cavity 414 and the midsole heel cavity 416. The midsole arch cavity 432 is formed to retain the raised arch shaped support piece 430. The raised arch shaped support piece 430 is designed to receive the shape of a natural curvature of the arch of a human foot.

Continuing to refer to FIGS. 18-20, in accordance with the present disclosure, an insole toe cavity 434 is formed in a substantially elliptical shape and located within the bottom insole surface 422 of the insole toe section 426. Included is an insole heel cavity 436 that is formed in a substantially oval shape and located within the bottom insole surface 422 of the insole heel section 428. An extruding toe comfort zone 438 is adhered to and located within the insole toe cavity 434 and an extruding heel comfort zone 440 is adhered to and located within the insole heel cavity 436. The midsole toe cavity 414 is designed to receive a bottom surface 442 of the extruding toe comfort zone 438, and the midsole heel cavity 416 is designed to receive a bottom surface 444 of the extruding heel comfort zone 440. The bottom insole surface 422 is adhered to the bottom midsole surface 412 and the bottom midsole surface 412 is adhered to the top outsole surface 404.

In one embodiment, as illustrated in FIGS. 17-20, the outsole 402 is formed from a material selected from the group consisting of rubber, leather, and polyurethane.

In another embodiment, as shown in FIGS. 17-20, the midsole 408 is formed from a material selected from the group consisting of ethyl vinyl acetate, plastic, rubber, and polyurethane.

In yet another embodiment, as reflected in FIGS. 18-20, the insole 418 is formed from a material selected from the group consisting of ethyl vinyl acetate, plastic, rubber, and polyurethane.

Continuing to refer to FIGS. 18-20, in one embodiment, the raised arch shaped support piece 430 is formed from a material selected from the group consisting of ethyl vinyl acetate, plastic, rubber, polyurethane foam, polyurethane gel, memory foam, vinyl, cork, and plastic.

In another embodiment, referring to FIGS. 18-20, the insole toe cavity 434, the insole heel cavity 436, the midsole toe cavity 414, and the midsole heel cavity 416 are reinforced with a spray on material selected from the group consisting of polyurethane, polyamide, and polyacrylonitrile, and combinations thereof.

In yet another embodiment, continuing to refer to FIGS. 18-20, the extruding toe comfort zone 438 and the extruding heel comfort zone 440 are formed from a material selected from the group consisting of rubber, polyurethane foam, polyurethane gel, memory foam, vinyl, cork, and plastic.

Turning to FIG. 20, in another related embodiment, the anti-fatigue shoe apparatus 400 further includes a tubular injection canal aperture 446 located in the outsole 402. The tubular injection canal aperture 446 leads to an outsole central injection canal 448 and a heel comfort zone canal 450 rises vertically from the outsole central injection canal 448 that terminates within the midsole heel cavity 416 through a midsole heel cavity injection aperture 452. A toe comfort zone canal 454 rises vertically from the outsole central injection canal 448 and terminates within the midsole toe cavity 414 through a midsole toe cavity injection aperture 456.

In accordance with such embodiment, continuing to refer to FIG. 20, the outsole central injection canal 448, the heel comfort zone canal 450, and the toe comfort zone canal 454 are designed to receive and retain the material of the extruding toe comfort zone 438 and the extruding heel comfort zone 440 in liquid form.

The embodiments of the anti-fatigue shoe apparatus 100, 200, 300, and 400, as described heretofore with reference to FIGS. 1-20, correspond to subject matter disclosed in the parent application. The following detailed description, in connection with FIGS. 21-24, sets forth a preferred embodiment of the present invention, designated as an anti-fatigue shoe apparatus 2100. This embodiment includes the specific improvements and novel features that are the subject of this Continuation-In-Part Application.

As illustrated in FIGS. 21-24, another preferred embodiment of an anti-fatigue shoe apparatus 2100 is presented. The description corresponding to the anti-fatigue shoe apparatus 100 can be suitably applied to the anti-fatigue shoe apparatus 2100, as well. Therefore, similar or like reference numerals may be applied wherever possible. Nonetheless, it will be appreciated that the anti-fatigue shoe apparatus 2100 includes additional features, details related to which shall be set out below. Although further description below has been applied to the anti-fatigue shoe apparatus 2100, aspects of the present disclosure can be applied to various items that can be worn over the foot of a wearer (not shown), which need not necessarily be limited to a shoe. Such items can include sandals, sneakers, loafers, moccasins, slip-ons, flip-flops, and the like. Usage of the term 'shoe' above, therefore, will be appreciated by those skilled in the art. The anti-fatigue shoe apparatus 2100 includes a main body portion 2104 and a sole assembly 2108.

The main body portion 2104 is adapted to cover a foot (e.g., an upper portion of the foot devoid of the underside sole area) of the wearer and is disposed generally above the sole assembly 2108. Further, the main body portion 2104 is secured to the sole assembly 2108. The main body portion 2104 defines an upper of the anti-fatigue shoe apparatus 2100 to at least partially cover and/or enclose the foot of the wearer. Further, the main body portion 2104 is configured to provide structural support, comfort, and aesthetic outward appearance to the anti-fatigue shoe apparatus 2100. The main body portion 2104 may be formed from one or more panels of flexible and/or semi-rigid material, such as leather, synthetic leather, fabric, mesh, or polymeric material, joined together by stitching, bonding, or molding. The main body portion 2104 may define a lower border (not shown) that can be used to be coupled with the sole assembly 2108, e.g., by use of adhesive bonding, stitching, and/or a combination thereof.

Figure 21:
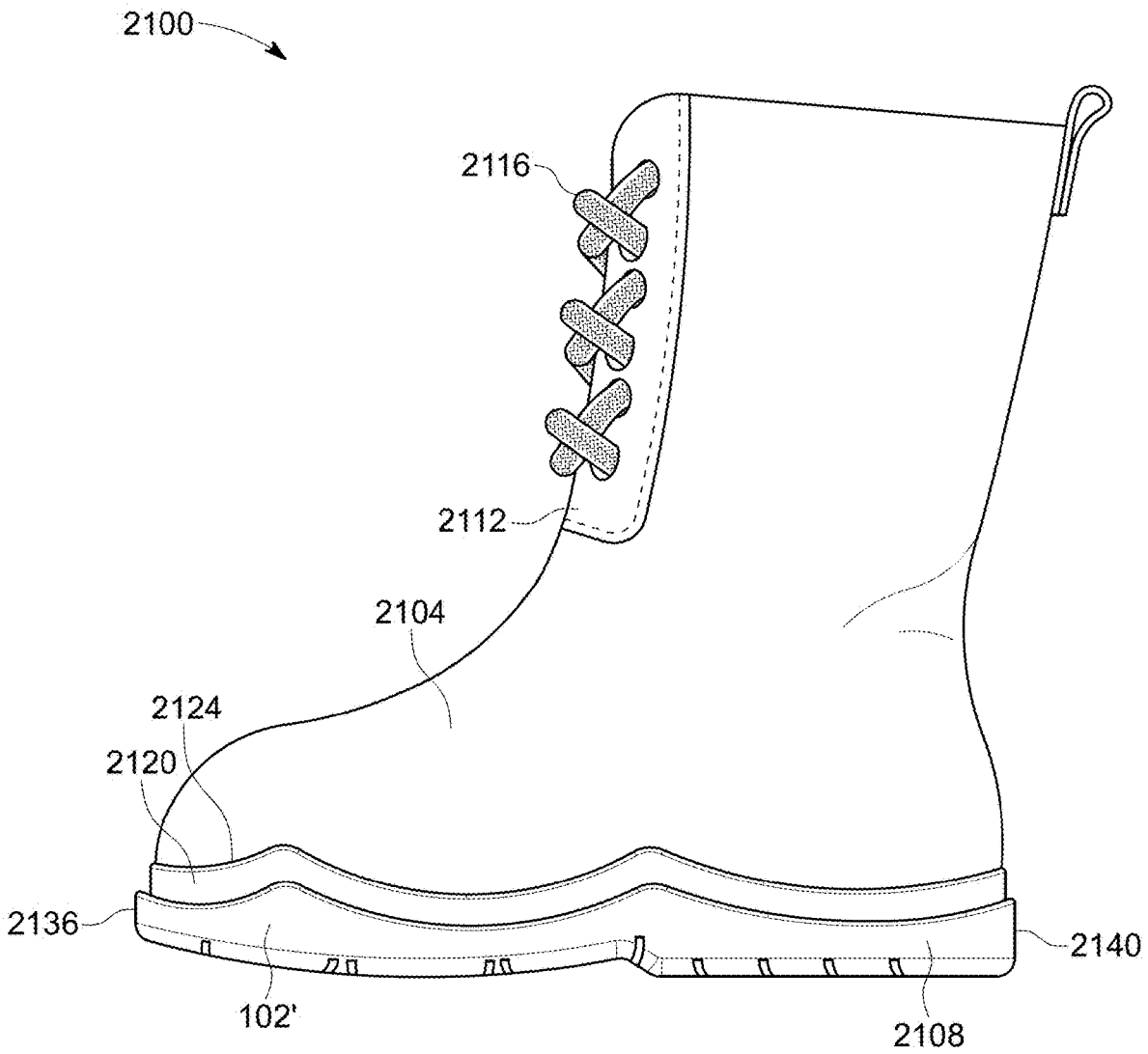
FIG. 21 is a right side elevation view of an anti-fatigue shoe apparatus within a work boot, according to a preferred embodiment of the present disclosure.
Figure 22:
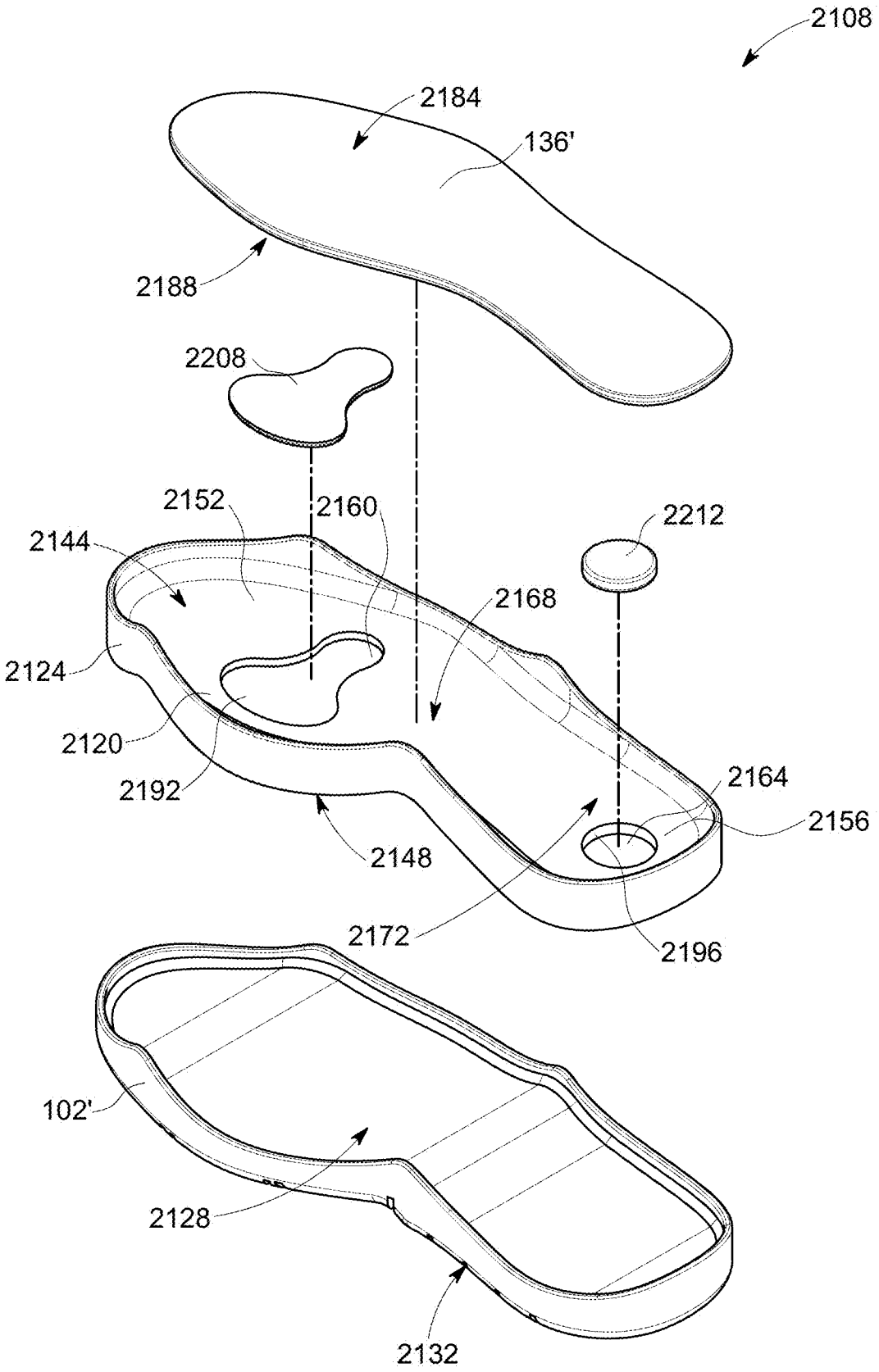
FIG. 22 is a top, rear, left side exploded perspective view of an anti-fatigue shoe apparatus, according to a preferred embodiment of the present disclosure.

As an example, the main body portion 2104 can define flaps-only one flap 2112 is visible in the orientation of the anti-fatigue shoe apparatus 2100 shown in FIG. 21 as the other flap is hidden behind the flap 2112 in FIG. 21. The flaps can be pulled towards each other to tighten and retain the main body portion 2104 around the foot. One or more of the flaps (e.g., flap 2112) can include a closure system 2116 to enable the flaps to be pulled towards each other for attaining a connection therebetween. In so doing, the main body portion 2104, and thus the anti-fatigue shoe apparatus 2100, can be retained over the foot. In some examples, the closure system 2116 can include a Velcro connection, a lace connection, or other connection mechanisms now known or in the future developed. Further, in some embodiments, the main body portion 2104 is formed from cloth and/or fabric, although a variety of other materials for the main body portion 2104 can be contemplated by those skilled in the art.

The sole assembly 2108 can acquire a position under or below a substantial part of the main body portion 2104, as shown in FIG. 21. As such, the sole assembly 2108 provides and/or serves as a supporting base for the main body portion 2104. The sole assembly 2108 includes multiple sole members, layered one over the other. As an example, the sole assembly 2108 includes an outsole 102, a midsole 2120, and an insole 136'. In an exemplary assembled state of the sole assembly 2108, the midsole 2120 acquires a position in between the outsole 102' and the insole 136', as also shown in the exemplary cross-sectional view of the sole assembly 2108 in FIG. 23. Also, in the assembled state of the sole assembly 2108, the outsole 102' may be positioned outside the main body portion 2104 while the insole 136' may be surrounded by the main body portion 2104 to be inside the main body portion 2104. Further, the sole assembly 2108 defines a peripheral edge 2124 that is coupled to the main body portion 2104, e.g., to the lower border (not shown or visible in the figures) of the main body portion 2104. Further, as an example, the sole assembly 2108 forms the lower of the anti-fatigue shoe apparatus 2100—i.e., to be positioned and/or disposed beneath the main body portion 2104.

The outsole 102' is analogous to the outsole 102 of the anti-fatigue shoe apparatus 100 described above. The outsole 102' is configured to abut and/or form a grip with the ground during use, e.g., for attaining traction with respect to the ground. The outsole 102' defines surfaces, e.g., a top outsole surface 2128 and a bottom outsole surface 2132. The bottom outsole surface 2132 is disposed opposite the top outsole surface 2128, as shown. The bottom outsole surface 2132 is adapted to in contact with the ground whereby the outsole 102' abuts and forms a grip with the ground during use. Conversely, the top outsole surface 2128 is directed upwards towards the main body portion 2104 of the anti-fatigue shoe apparatus 2100. In some embodiments, the outsole 102 is formed from a material selected from a group consisting of rubber, leather, and polyurethane.

Although not limited, the outsole 102' may include ergonomic contours and shapes for compatibility with the wearer's foot during use. Also, the outsole 102' may be flexible to accommodate foot flexures during use. In some embodiments, the outsole 102' may include one or more of the same features as that of the outsole 102, described above, and thus can include features such as the raised arch, and the like components or features, associated with the outsole 102. The outsole 102', the midsole 2120, and the insole 136' integrate seamlessly and can function as a single unit. While insoles (e.g., the insole 136') may be used in conjunction with the anti-fatigue shoe apparatus 2100, in some cases, they are not integral to the anti-fatigue shoe apparatus 2100 and thus the insole 136' can be altered and/or removed based on individual preferences and/or specific foot types and/or foot sizes.

Figure 23:
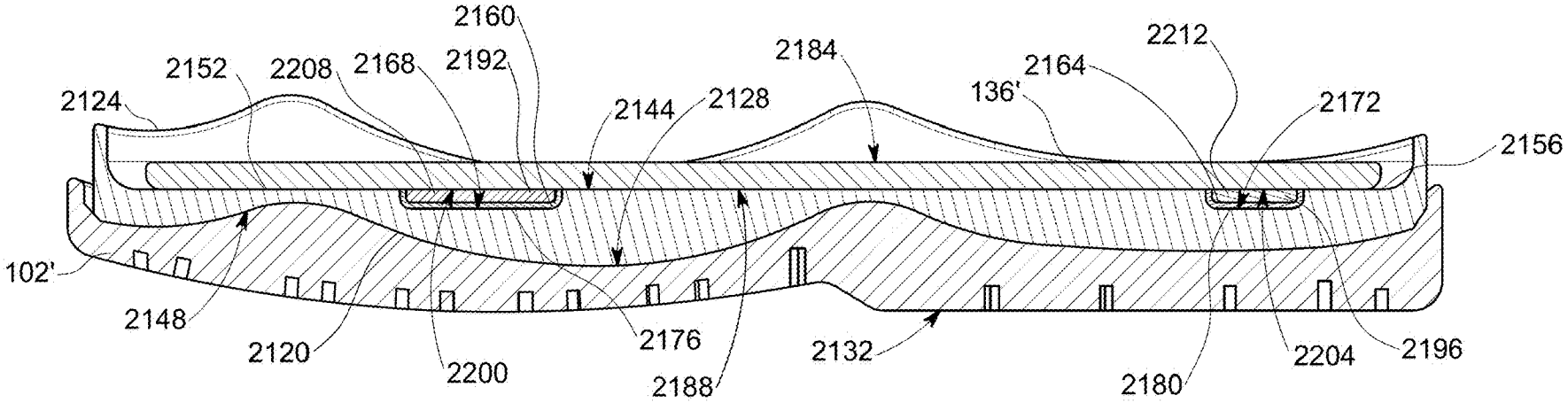
FIG. 23 is a right side cross-sectional elevation view thereof, according to preferred embodiments.

The midsole 2120 may be analogous with the midsole 108, but can be crafted from a softer material than the outsole 102. As an example, the midsole 2120 is configured to reinforce an assembly between the insole 136' and the outsole 102' to reduce a torque and/or a torsional movement between a front 2136 of the sole assembly 2108 and a rear 2140 of the sole assembly 2108. The midsole 2120 can absorb shock from walking or standing, offer a stable base for the foot, and also provide a secondary layer of protection to the foot of the wearer. In some examples, the midsole 2120 may define a top midsole surface 2144 and a bottom midsole surface 2148, as can be seen in FIG. 23. The bottom midsole surface 2148 is disposed opposite the top midsole surface 2144. Further, the bottom midsole surface 2148 is in contact with the top outsole surface 2128. In some embodiments, the top midsole surface 2144 includes a midsole toe section 2152 and a midsole heel section 2156 which is disposed opposite the midsole toe section 2152. According to some aspects of the present disclosure, the midsole 2120 includes one or more carve outs and/or cavities, such as a midsole toe cavity 2160 and a midsole heel cavity 2164.

The midsole toe cavity 2160 is disposed through the midsole toe section 2152 of the top midsole surface 2144 into a midsole body of the midsole 2120, e.g., to be recessed or indented with respect to the midsole toe section 2152 and define a first midsole surface 2168. Similarly, the midsole heel cavity 2164 is disposed through the midsole heel section 2156 of the top midsole surface 2144 into the midsole body of the midsole 2120, e.g., to be recessed or indented with respect to the midsole heel section 2156 and define a second midsole surface 2172. In some embodiments, the bottom midsole surface 2148 is coupled or integrally formed with the top outsole surface 2128. The integral formation provides for a better and more reliable integrated structure of the anti-fatigue shoe apparatus 2100. Although not limited, the midsole 2120 can be formed from a material selected from a group consisting of ethyl vinyl acetate, plastic, rubber, and polyurethane, although other materials now known or in the future developed may be contemplated to be used for producing the midsole 2120.

In some embodiments, both the midsole toe cavity 2160 and the midsole heel cavity 2164 can be formed in a substantially elliptical shape or an irregular shape, e.g., when viewed from the top. The term 'substantially' can account for manufacturing tolerances. Also, the midsole toe cavity 2160 can be U-shaped or bowl shaped from a side of the anti-fatigue shoe apparatus 2100. Similarly, the midsole heel cavity 2164 can be U-shaped or bowl shaped from a side of the anti-fatigue shoe apparatus 2100. In some embodiments, the anti-fatigue shoe apparatus 2100 can include a midsole toe liner 2176 and a midsole heel liner 2180, as seen in FIG. 23. The midsole toe cavity 2160 can be lined with the midsole toe liner 2176 and the midsole heel cavity 2164 can be lined with the midsole heel liner 2180. As an example, the midsole toe liner 2176 may be laid against (e.g., adhered or coupled to) the first midsole surface 2168 of the midsole toe cavity 2160, while the midsole heel liner 2180 may be laid against (e.g., adhered or coupled to) the second midsole surface 2172 of the midsole heel cavity 2164. Although not limited, the midsole toe liner 2176 and the midsole heel liner 2180 can be formed from a material selected from the group consisting of rubber, leather, plastic, felt, fabric, and polyurethane. In some embodiments, the midsole toe cavity 2160 and the midsole heel cavity 2164 can be reinforced with a spray on material, which may be selected from the group consisting of polyurethane, polyamide, and polyacrylonitrile, and combinations thereof.

The insole 136' includes a top insole surface 2184 and a bottom insole surface 2188. The bottom insole surface 2188 is disposed opposite the top insole surface 2184. The top insole surface 2184 is adapted to be in contact with the foot of the wearer when the wearer wears the anti-fatigue shoe apparatus 2100. The bottom insole surface 2188 is in contact with the top midsole surface 2144. According to an aspect of the present disclosure, a toe comfort zone 2192 is defined within the midsole toe cavity 2160 of the midsole 2120, and the same is delimited by the first midsole surface 2168 of the midsole 2120 and a first insole surface 2200 of the bottom insole surface 2188. Similarly, a heel comfort zone 2196 is defined within the midsole heel cavity 2164, and the same is delimited by the second midsole surface 2172 of the midsole 2120 and a second insole surface 2204 of the bottom insole surface 2188. In some embodiments, the bottom insole surface 2188 is coupled or integrally formed with the top midsole surface 2144. Such construction provides for a better and more reliable integrated structure of the anti-fatigue shoe apparatus 2100.

In some examples, the toe comfort zone 2192 within the midsole toe cavity 2160 also includes (or accommodates) a toe comfort pod 2208 formed from a material selected from the group consisting of rubber, polyurethane foam, polyurethane gel, memory foam, vinyl, cork, and plastic. Similarly, the heel comfort zone 2196 within the midsole heel cavity 2164 also includes (or accommodates) a heel comfort pod 2212 formed from a material selected from the group consisting of rubber, polyurethane foam, polyurethane gel, memory foam, vinyl, cork, and plastic. The comfort pods 2208, 2212 are made from a relatively soft yet robust material to withstand daily impacts from walking, standing, or running. The comfort pods 2208, 2212 are placed within the midsole's carve-outs/cavities 2164, 2160, to offer comfort in the high-impact areas of the foot, particularly under the forefoot and/or the heel. According to some embodiments, the midsole toe liner 2176 separates the midsole 2120 from the toe comfort zone 2192. Similarly, the midsole heel liner 2180 separates the midsole 2120 from the heel comfort zone 2196.

In some embodiments, the comfort zones 2192, 2196 include the comfort pods 2208, 2212 that are removable and replaceable, e.g., in cases where the midsole 2120 can be removable from the insole 136'. Additionally, one or more comfort pods 2208, 2212 can be changed for one or more other comfort pods 2208, 2212 so as to accommodate comfort pods of different densities to be applied within the anti-fatigue shoe apparatus 2100. Further, the one or more comfort pods 2208, 2212 can be changed for one or more other comfort pods so as to allow for the comfort zones 2192, 2196 to include different materials. As an example, some materials associated with the comfort pods 2208, 2212 can keep the foot of the wearer relatively cooler, while other materials allow for better air flow to the foot. Yet other materials can help in insulating the foot (e.g., for heat retention around the foot). Still other materials can offer varying degrees of support for the foot. Further, a shape and/or a profile of the comfort pods 2208, 2212, and also the shape and/or a profile of the midsole toe cavity 2160 and the midsole heel cavity 2164 in which they are placed, need not be limited to any particular shape, and thus can include an elliptical shape, an oblong shape, a circular shape, a rectangular shape, an irregular shape, a customized shape according to the foot, and like shapes and/or profiles now known or in the future developed. Also, a depth and/or a thickness of the comfort pods 2208, 2212 can vary from one application to another application. In some working examples, said shapes and/or profile can depend upon the shape and/or a profile of the foot.

Figure 24:
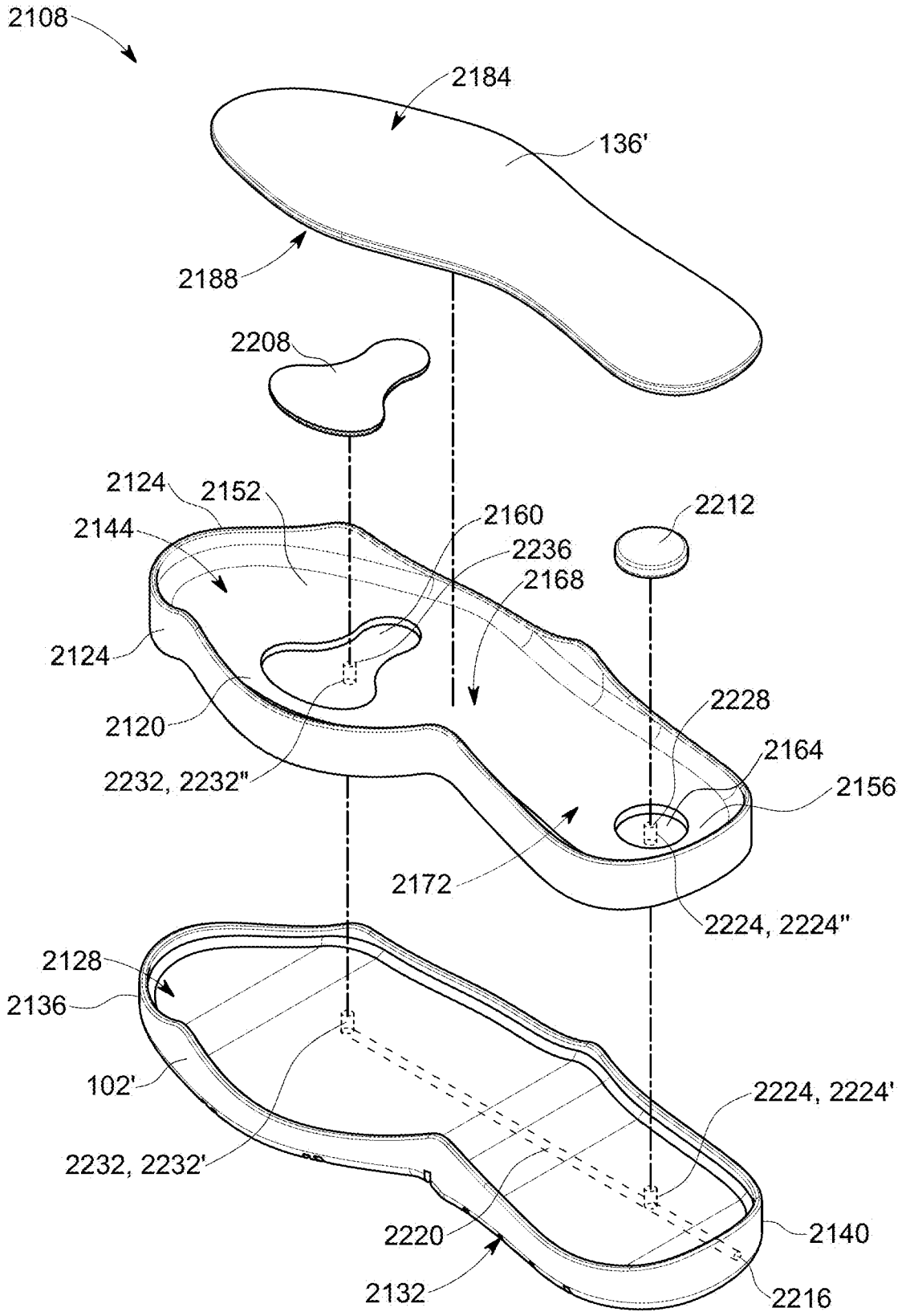
FIG. 24 is a top, rear, left side exploded perspective view of an anti-fatigue shoe apparatus, illustrating additional and/or optional details of said anti-fatigue shoe apparatus, according to an embodiment of the present disclosure.

According to some embodiments of the present disclosure, and with reference to FIG. 24, the anti-fatigue shoe apparatus 2100 includes a tubular injection canal aperture 2216 disposed in the outsole 102', e.g., at the rear 2140 of the sole assembly 2108. The tubular injection canal aperture 2216 leads into an outsole central injection canal 2220. The outsole central injection canal 2220 longitudinally extends along a length of the anti-fatigue shoe apparatus 2100 and through the outsole 102', as shown in FIG. 24. A heel comfort zone canal 2224 rises (e.g., vertically) from said outsole central injection canal 2220 and extends through each of the outsole 102' and the midsole 2120 to terminate and be revealed within the midsole heel cavity 2164 at a midsole heel cavity injection aperture 2228. The heel comfort zone canal 2224 defines canal segments 2224, 2224" within both the outsole 102' and the midsole 2120. Similarly, a toe comfort zone canal 2232 rises (e.g., vertically) from the outsole central injection canal 2220 and extends through each of the outsole 102' and the midsole 2120 to terminate and be revealed within the midsole toe cavity 2160 at a midsole toe cavity injection aperture 2236. The toe comfort zone canal 2232 defines canal segments 2232, 2232" within both the outsole 102 and the midsole 2120. The outsole central injection canal 2220, the heel comfort zone canal 2224, and the toe comfort zone canal 2232 are adapted to receive and retain a material of the toe comfort zone 2192 and the heel comfort zone 2196 in liquid form.

By way of the canals 2220, 2224, 2232 comfort pods 2208, 2212 or the comfort zones 2192, 2196 are integrated directly into the sole assembly 2108, rather than relying solely on thin insoles that can be removed. More particularly, the network of canals 2220, 2224, 2232 strategically positions cushioning materials such as memory foam or PVC gel into the comfort zones 2192, 2196. These comfort zones 2192, 2196 acquire a position under or beneath high-impact zones of the foot of the wearer, such as the ball and heel of the foot. More particularly, the toe comfort zone 2192 is configured to be positioned beneath a ball of a foot of a wearer when the footwear or the anti-fatigue shoe apparatus 2100 is worn and the heel comfort zone 2196 is configured to be positioned beneath a heel of the foot of the wearer when the footwear or the anti-fatigue shoe apparatus 2100 is worn. In that manner, the anti-fatigue shoe apparatus 2100 enhances comfort, reduces foot fatigue, and maintains necessary protection, as the comfort features or the comfort pods 2208, 2212 are strategically placed in areas where softer materials are beneficial without compromising protection from environmental elements encountered during work, e.g., when the anti-fatigue shoe apparatus 2100 is embodied as a work boot.

It will be apparent to persons skilled in the relevant art that various changes in form and detail can be made without departing from the spirit and scope of the disclosure. While various embodiments of the present disclosure have been described above, it should be understood that they have been presented by way of example only, and not limitation. Thus, the breadth and scope of the present disclosure should not be limited by any of the above-described exemplary embodiments, but should only be defined in accordance with the following claims and their equivalents. All patents and publications discussed herein are incorporated in their entirety by reference thereto.

What is claimed is:

1. A sole assembly for a footwear, the sole assembly comprising:

an outsole defining a top outsole surface and a bottom outsole surface opposite to the top outsole surface, the bottom outsole surface adapted to contact ground;

a midsole to reduce a torque or a torsional movement between a front of the sole assembly and a rear of the sole assembly, the midsole defining a top midsole surface and a bottom midsole surface opposite to the top midsole surface, the bottom midsole surface in contact with the top outsole surface, the top midsole surface including a midsole toe section and a midsole heel section opposite to the midsole toe section, the midsole including:

a midsole toe cavity extending from the midsole toe section of the top midsole surface into a midsole body of the midsole;

a midsole heel cavity extending from the midsole heel section of the top midsole surface into the midsole body of the midsole; and an insole including a top insole surface and a bottom insole surface disposed opposite to the top insole surface, the bottom insole surface being in contact with the top midsole surface, wherein a toe comfort zone is defined within the midsole toe cavity, the toe comfort zone is delimited by a first midsole surface of the midsole and a first insole surface of the insole, and a heel comfort zone is defined within the midsole heel cavity, the heel comfort zone is delimited by a second midsole surface of the midsole and a second insole surface of the insole;

a tubular injection canal aperture disposed in the outsole, said tubular injection canal aperture leading to an outsole central injection canal; and a heel comfort zone canal rising vertically from said outsole central injection canal terminating within the midsole heel cavity through a midsole heel cavity injection aperture and a toe comfort zone canal rising vertically from said outsole central injection canal terminating within the midsole toe cavity through a midsole toe cavity injection aperture, wherein said outsole central injection canal, said heel comfort zone canal, and said toe comfort zone canal adapted to receive and retain the material of the toe comfort zone and the heel comfort zone in liquid form.

2. The sole assembly of claim 1, wherein the outsole is formed from a material selected from a group consisting of rubber, leather, and polyurethane.

3. The sole assembly of claim 1, wherein the midsole is formed from a material selected from a group consisting of ethyl vinyl acetate, plastic, rubber, and polyurethane.

4. The sole assembly of claim 1, wherein the bottom midsole surface is integrally formed with the top outsole surface.

5. The sole assembly of claim 1, wherein the bottom insole surface is integrally formed with the top midsole surface.

6. The sole assembly of claim 1, wherein the midsole toe cavity is lined with a midsole toe liner and the midsole heel cavity is lined with a midsole heel liner.

7. The sole assembly of claim 6, wherein said midsole toe liner and said midsole heel liner are formed from a material selected from the group consisting of rubber, leather, plastic, felt, fabric, and polyurethane.

8. The sole assembly of claim 1, wherein the midsole toe cavity and the midsole heel cavity are reinforced with a spray on material selected from the group consisting of polyurethane, polyamide, and polyacrylonitrile, and combinations thereof.

9. The sole assembly of claim 1, wherein the toe comfort zone and the heel comfort zone correspondingly include comfort pods formed from a material selected from the group consisting of rubber, polyurethane foam, polyurethane gel, memory foam, vinyl, cork, and plastic.

10. An anti-fatigue shoe apparatus, comprising:

a main body portion configured to cover a foot of a wearer; and a sole assembly defining a peripheral edge coupled to the main body portion and providing a supporting base for the main body portion, the sole assembly including:

an outsole defining a top outsole surface and a bottom outsole surface opposite to the top outsole surface, the bottom outsole surface adapted to contact ground;

a midsole to reduce a torque or a torsional movement between a front of the sole assembly and a rear of the sole assembly, the midsole defining a top midsole surface and a bottom midsole surface opposite to the top midsole surface, the bottom midsole surface in contact with the top outsole surface, the top midsole surface including a midsole toe section and a midsole heel section opposite to the midsole toe section, the midsole including:

a midsole toe cavity extending from the midsole toe section of the top midsole surface into a midsole body of the midsole;

a midsole heel cavity extending from the midsole heel section of the top midsole surface into the midsole body of the midsole; and an insole including a top insole surface and a bottom insole surface disposed opposite to the top insole surface, the bottom insole surface being in contact with the top midsole surface, wherein a toe comfort zone is defined within the midsole toe cavity, the toe comfort zone is delimited by a first midsole surface of the midsole and a first insole surface of the insole, and a heel comfort zone is defined within the midsole heel cavity, the heel comfort zone is delimited by a second midsole surface of the midsole and a second insole surface of the insole:

a tubular injection canal aperture disposed in the outsole, said tubular injection canal aperture leading to an outsole central injection canal; and a heel comfort zone canal rising vertically from said outsole central injection canal terminating within the midsole heel cavity through a midsole heel cavity injection aperture and a toe comfort zone canal rising vertically from said outsole central injection canal terminating within the midsole toe cavity through a midsole toe cavity injection aperture, wherein said outsole central injection canal, said heel comfort zone canal, and said toe comfort zone canal adapted to receive and retain the material of the toe comfort zone and the heel comfort zone in liquid form.

11. The anti-fatigue shoe apparatus of claim 10, wherein the outsole is formed from a material selected from a group consisting of rubber, leather, and polyurethane.

12. The anti-fatigue shoe apparatus of claim 10, wherein the midsole is formed from a material selected from a group consisting of ethyl vinyl acetate, plastic, rubber, and polyurethane.

13. The anti-fatigue shoe apparatus of claim 10, wherein the bottom midsole surface is integrally formed with the top outsole surface.

14. The anti-fatigue shoe apparatus of claim 10, wherein the bottom insole surface is integrally formed with the top midsole surface.

15. The anti-fatigue shoe apparatus of claim 10, wherein the midsole toe cavity is lined with a midsole toe liner and the midsole heel cavity is lined with a midsole heel liner.

16. The anti-fatigue shoe apparatus of claim 15, wherein said midsole toe liner and said midsole heel liner are formed from a material selected from the group consisting of rubber, leather, plastic, felt, fabric, and polyurethane, and the midsole toe cavity and the midsole heel cavity are reinforced with a spray on material selected from the group consisting of polyurethane, polyamide, and polyacrylonitrile, and combinations thereof.

17. The anti-fatigue shoe apparatus of claim 10, wherein the toe comfort zone and the heel comfort zone correspondingly include comfort pods formed from a material selected from the group consisting of rubber, polyurethane foam, polyurethane gel, memory foam, vinyl, cork, and plastic.

18. A sole assembly for a footwear, the sole assembly comprising:

an outsole defining a top outsole surface and a bottom outsole surface opposite to the top outsole surface, the bottom outsole surface adapted to contact ground;

a midsole defining a top midsole surface and a bottom midsole surface opposite to the top midsole surface, the bottom midsole surface in contact with the top outsole surface, the top midsole surface including a midsole toe section and a midsole heel section opposite to the midsole toe section, the midsole including:

a midsole toe cavity extending from the midsole toe section of the top midsole surface into a midsole body of the midsole;

a midsole heel cavity extending from the midsole heel section of the top midsole surface into the midsole body of the midsole;

an insole including a top insole surface and a bottom insole surface disposed opposite to the top insole surface, the bottom insole surface being in contact with the top midsole surface, wherein a toe comfort zone is defined within the midsole toe cavity, the toe comfort zone is delimited by a first midsole surface of the midsole and a first insole surface of the insole, the toe comfort zone is configured to be positioned beneath a ball of a foot of a wearer when the footwear is worn, and a heel comfort zone is defined within the midsole heel cavity, the heel comfort zone is delimited by a second midsole surface of the midsole and a second insole surface of the insole, the heel comfort zone is configured to be positioned beneath a heel of the foot of the wearer when the footwear is worn, a tubular injection canal aperture disposed in the outsole, said tubular injection canal aperture leading to an outsole central injection canal; and a heel comfort zone canal rising vertically from said outsole central injection canal terminating within the midsole heel cavity through a midsole heel cavity injection aperture and a toe comfort zone canal rising vertically from said outsole central injection canal terminating within the midsole toe cavity through a midsole toe cavity injection aperture, wherein said outsole central injection canal, said heel comfort zone canal, and said toe comfort zone canal adapted to receive and retain the material of the toe comfort zone and the heel comfort zone in liquid form.

* * * * *